US010717508B2

(12) United States Patent
Wiens et al.

(10) Patent No.: US 10,717,508 B2
(45) Date of Patent: Jul. 21, 2020

(54) ACTUATION SYSTEM FOR SWIMMING ROBOTS

(71) Applicant: Massachusetts Institute of Technology, Cambridge, MA (US)

(72) Inventors: Alexander Joshua Wiens, San Jose, CA (US); Anette E. Hosoi, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 16/194,113

(22) Filed: Nov. 16, 2018

(65) Prior Publication Data

US 2019/0152573 A1 May 23, 2019

Related U.S. Application Data

(60) Provisional application No. 62/723,440, filed on Aug. 27, 2018, provisional application No. 62/588,171, filed on Nov. 17, 2017.

(51) Int. Cl.

| | |
|---|---|
| ***B63H 1/36*** | (2006.01) |
| ***B63G 8/00*** | (2006.01) |
| *B63G 8/20* | (2006.01) |

(52) U.S. Cl.

CPC ..... *B63G 8/001* (2013.01); *B63H 1/36* (2013.01); *B63G 8/20* (2013.01); *B63G 2008/002* (2013.01); *B63G 2008/004* (2013.01)

(58) Field of Classification Search

CPC .... B63G 8/001; B63G 8/20; B63G 2008/002; B63G 2008/004; B63H 1/36

See application file for complete search history.

(56) References Cited

U.S. PATENT DOCUMENTS

| | | | |
|---|---|---|---|
| 5,839,700 | A | 11/1998 | Nedderman, Jr. |
| 6,377,352 | B1 | 4/2002 | Coronato et al. |
| 6,974,356 | B2 | 12/2005 | Hobson et al. |
| 7,865,268 | B2 | 1/2011 | Valdivia y Alvarado et al. |
| 9,987,468 | B2 * | 6/2018 | Bagwell ..... A61B 17/3401 |
| 2002/0109433 | A1 | 8/2002 | Rayner et al. |
| 2014/0309779 | A1 | 10/2014 | Niu |
| 2015/0239539 | A1 | 8/2015 | Geder et al. |

OTHER PUBLICATIONS

International Search Report and Written Opinion dated Jan. 16, 2019 for Application No. PCT/US2018/061596.

Alben et al., Dynamics of freely swimming flexible foils. Physics of Fluids. May 1, 2012;24:051901(1-25).

Clapham et al., iSplash-II: Realizing fast carangiform swimming to outperform a real fish. 2014 IEEE/RSJ International Conference on Intelligent Robots and Systems (IROS 2014). Chicago, Illinois. Sep. 14-18, 2014,1080-1086.

(Continued)

*Primary Examiner* — Stephen P Avila

(74) *Attorney, Agent, or Firm* — Wolf, Greenfield & Sacks, P.C.

(57) ABSTRACT

Underwater robotic systems are disclosed. In some instances, a robotic system may include a body, a flexible fin, and a rotatable mass associated with the body such that angular acceleration of the rotatable mass causes a reaction torque that rotates the body to deform the flexible fin to create thrust in water.

37 Claims, 16 Drawing Sheets

(56) References Cited

OTHER PUBLICATIONS

Crespi et al., AmphiBot I: An amphibious snake-like robot. Robotics and Autonomous Systems. Mar. 31, 2005;50(4):163-175.
Domenici et al., The kinematics and performance of fish fast-start swimming. The Journal of Experimental Biology. 1997;200:1165-78.
Eloy, On the best design for undulatory swimming. Journal of Fluid Mechanics. Feb. 25, 2013;717:1-41. Author Manuscript.
Gazzola et al., Gait and speed selection in slender inertial swimmers. Proceeding of the National Academy of Sciences of the United States. PNAS Early Edition. Mar. 31, 2015;112(3):16. Supporting Info, 6 pages.
Hu, Biologically inspired design of autonomous robotic fish at Essex. Proc IEEE SMC UK-RI Chapter Conference 2006 on Advances in Cybernetic Systems. Sheffield, England. Sep. 7-8, 2006,ISSN 1744-9170, 1-8.
Jusufi et al., Undulatory Swimming Performance and Body Stiffness Modulation in a Soft Robotic Fish-Inspired Physical Model. Soft Robotics. Sep. 1, 2017; 4(3):202-210. doi: 10.1089/soro.2016.0053.
Katzschmann et al., Exploration of underwater life with an acoustically controlled soft robotic fish. Science Robotics. Mar. 21, 2018;3(16),eaar3449,1-12.
Lauder et al., Passive robotic models of propulsion by the bodies and caudal fins of fish. Integr Comp Biol. Nov. 2012;52(5):576-87. doi: 10.1093/icb/ics096. Epub Jun. 26, 2012.
Lighthill, Aquatic animal propulsion of high hydromechanical efficiency. Journal of Fluid Mechanics. Nov. 11, 1970;44(2):265-301.
Lighthill, Hydromechanics of aquatic animal propulsion. Annual Review of Fluid Mechanics. Jan. 1969;1:413-446.
Lighthill, Large-amplitude elongated-body theory of fish locomotion. Proceeding of the Royal Society B: Biological Science. Nov. 16, 1971;179(1055):125-138.
Lighthill, Mathematical Biofluiddynamics. Society for Industrial and Applied Mathematics (SIAM). 1975. 278 pages.
Lighthill, Note on the swimming of slender fish. Journal of Fluid Mechanics. Oct. 1960;9(2):305-317.
Lim et al., Mechanisms of anguilliform locomotion in fishes studied using simple three-dimensional physical models. Bioinspir Biomim. Jul. 5, 2016;11(4):046006. doi: 10.1088/17483190/11/4/046006. Accepted Manuscript, 30 pages.
Lucas et al., Effects of non-uniform stiffness on the swimming performance of a passively-flexing, fish-like foil model. Bioinspir Biomim. Oct. 8, 2015;10(5):056019, 16 pages.
Maertens et al., Efficiency of fish propulsion. Bioinspir Biomim. 2015;10(4):046013, 11 pages.
Marchese et al., Autonomous Soft Robotic Fish Capable of Escape Maneuvers Using Fluidic Elastomer Actuators. Soft Robot. Mar. 1, 2014; 1(1): 75-87.
Paraz et al., Thrust generation by a heaving flexible foil: Resonance, nonlinearities, and optimality. Physics of Fluids. Jan. 14, 2016;28(1):011903, 18 pages.
Piñeirua et al., Modelling of an actuated elastic swimmer. Journal of Fluid Mechanics. Dec. 22, 2017;829:731-750.
Pollard et al., Direct tail actuation vs internal rotor propulsion in aquatic robots. ASME 2017 Dynamic Systems and Control Conference. Oct. 11, 2017. DSCC2017-5208, 6 pages.
Prempraneerach et al., The effect of chordwise flexibility on the thrust and efficiency of a flapping foil. MIT. In Proc 13$^{th}$ Intl Symp on Unmanned Untethered Submersible Tech: special session on bioengineering research related to autonomous underwater vehicles. 2003. 11 pages.
Quinn et al., Scaling the propulsive performance of heaving flexible panels. Journal of Fluid Mechanics. Jan. 10, 2014;738:250-267.
Ramananarivo et al., Passive elastic mechanism to mimic fish-muscle action in anguilliform swimming. Journal of the Royal Society Interface. Nov. 6, 2013;10(88):20130667,1-8.
Singh et al., The effect of non-uniform damping on flutter in axial flow and energy harvesting strategies. Proceedings of the Royal Society A. Mathematical Physical and Engineering Sciences. Jul. 27, 2012; 468:3620-35. 12 pages.
Triantafyllou et al., Hydrodynamics of Fishlike Swimming. Annual Review of Fluid Mechanics. Jan. 2000;32(1):33-53.
Valdivia Y Alvarado, Design of biomimetic compliant devices for locomotion in liquid environments. MIT Thesis. Doctor of Philosophy in Mechanical Engineering. pp. 1-164. Available to the public Sep. 28, 2007, 169 pages.
Valdivia Y Alvarado et al., Design of Machines With Compliant Bodies for Biomimetic Locomotion in Liquid Environments. ASME. J Dyn Sys Meas Control. Mar. 2006;128:3-13.
Valdivia Y Alvarado et al., Performance of Machines With Flexible Bodies Designed for Biomimetic Locomotion in Liquid Environments. Proceedings of the 2005 IEEE International Conference on Robotics and Automation (ICRA 2005). Barcelona, Spain. Apr. 2005;3324-9.
Wiens et al., Self-similar kinematics among efficient slender swimmers. Journal of Fluid Mechanics. Apr. 2018;840:106-130.
Zhang et al., A flexible, reaction-wheel-driven fish robot: Flow sensing and flow-relative control. American Control Conference. Jul. 2016:1221-1226. DOI: 10.1109/Acc.2016.7525084.
Zhong et al., A novel robot fish with wire-driven active body compliant tail. IEEE/ASME Transactions on Mechatronics. Aug. 2017;22(4):1633-1643. Epub Jun. 7, 2017.

* cited by examiner

ACTUATION SYSTEM FOR SWIMMING ROBOTS

CROSS-REFERENCE TO RELATED APPLICATIONS

This application claims the benefit of priority under 35 U.S.C. § 119(e) of U.S. provisional application Ser. No. 62/588,171, filed Nov. 17, 2017, and U.S. provisional application Ser. No. 62/723,440, filed Aug. 27, 2018, the disclosures of each of which are incorporated herein by reference in their entirety.

GOVERNMENT LICENSE RIGHTS

This invention was made using Government support under Grant No. DMS-1517842 awarded by the National Science Foundation. The Government has certain rights in the invention.

FIELD

Disclosed embodiments are related to an actuation system for swimming robots.

BACKGROUND

Over the past few decades autonomous underwater vehicles (AUVs) have come to play a critical role in the mapping and exploration of our oceans. Autonomous robotic systems are currently applied within a wide range of ocean operations with examples including long range sensing, mapping, inspection, and maintenance or repair of underwater structures. In an effort to meet the operational requirements of these different tasks, engineers have designed a host of different underwater robotic platforms. Each of these robotic platforms are designed with mission-specific operational capabilities. For example, some robotic platforms are torpedo-like vehicles for long range sensing missions which require speed and efficiency, while others are slower cube-shaped thruster vehicles for inspection and maintenance tasks which require agility and precision. Although many of these AUVs are effective in their mission-specific operational capabilities, they are extremely costly to build, maintain, and operate. Additionally, these AUVs have complex mechanical systems designed for the different applications.

SUMMARY

According to one embodiment, a robotic system includes a body, at least one flexible fin attached to the body, and a first rotatable mass operatively coupled to the body. The angular acceleration of the first rotatable mass relative to the body creates a reaction torque that rotates the body to deform the at least one flexible fin.

According to another embodiment, a method for operating a robotic system includes applying an angular acceleration to a first rotatable mass relative to a body the first rotatable mass is operatively coupled with to apply a reaction torque to the body. The method further includes rotating the body in response to the reaction torque applied to the body and deforming at least one flexible fin attached to the body in response to rotating the body.

According to yet another embodiment, a method for operating a robotic system includes cyclically rotating a body in a first direction of rotation and a second direction of rotation at a predetermined frequency and deforming at least one flexible fin attached to the body in response to rotating the body. The predetermined frequency is a resonance frequency of the at least one flexible fin.

It should be appreciated that the foregoing concepts, and additional concepts discussed below, may be arranged in any suitable combination, as the present disclosure is not limited in this respect. Further, other advantages and novel features of the present disclosure will become apparent from the following defined description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DEFINED DESCRIPTION

Figure 1:
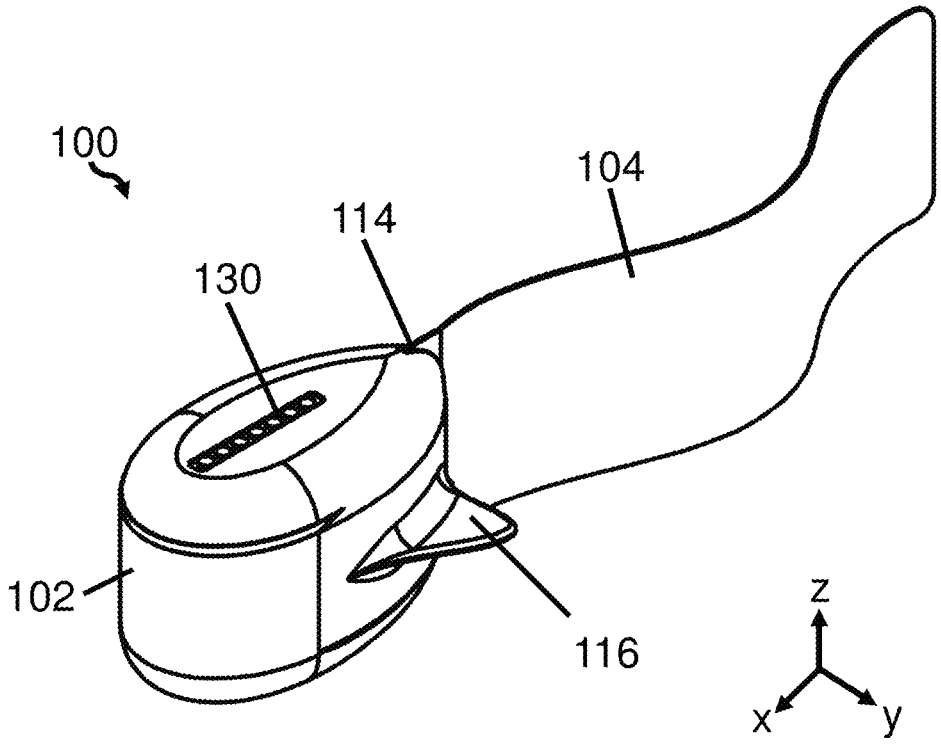
FIG. 1 depicts a perspective view of a robotic system according to an embodiment.

In recent years there have been some successes in academic research in ocean animal emulation. These prior robotic systems are capable of swimming at relatively high speeds while also executing precise agile maneuvers. However, this performance comes at the cost of high mechanical complexity. These vehicles emulate the movements of swimming animals by using elaborate multi-link actuation systems with many components. This mechanical complexity tends to make these systems expensive to build and maintain, and also increases the probability of mechanical failure. Other robotic systems integrate rigid actuators inside of soft elastic components used to generate thrust. However, these conventional systems tend to perform well below the levels of the more mechanically complex counterparts. Additionally, the design of such systems traditionally requires an expensive and complicated manufacturing process that includes directly integrating rigid components inside of soft components which makes them challenging and expensive to manufacture.

In view of the above, the Inventors have recognized a need for a simple multi-purpose robotic system which can replace the operational capabilities of many different conventional AUVs. In working towards this goal, ocean animals present an impressive example of what is possible in a well-designed underwater vehicle. In speed, agility, and efficiency, swimming animals can far outperform even the most capable conventional robotic counterparts. Recognizing these benefits, the Inventors have studied how these animals swim and how these principles may be used to inform the design of high-performance underwater vehicles. Based on these studies, the Inventors have recognized the benefits associated with a robotic system which uses a flexible fin attached to a body to replace the numerous mechanical linkages used by conventional robotic swimmers. To generate propulsive undulations that emulate fish-like swimming, the Inventors have further recognized the benefits of using an actuator corresponding to a rotatable mass attached to the body. The actuator may be used to apply a cyclically oscillating reaction torque to the body which deforms the flexible fin in a propagating elastic wave which produces controllable and efficient thrust. Thus, the disclosed robotic system may exhibit high performance in speed and agility while simplifying mechanical complexity, reducing cost, and increasing reliability.

According to one embodiment of the present disclosure, a robotic system may include a body, a flexible fin attached to the body, and a rotatable mass operatively coupled to the body. Angular acceleration of the rotatable mass relative to the body creates a reaction torque in the body, such that the body deforms the flexible fin. The flexible fin, being elastic, returns to an unstressed configuration from the deformation caused by the reaction torque. Thus, the elastic deformation and recovery of the fin displaces surrounding fluid to generate thrust that propels the robotic system. Accordingly, cyclically oscillating or accelerating the rotatable mass in a first and second rotational direction to apply reaction torques to the body may create a propagating elastic wave in the flexible fin that creates consistent and efficient thrust for the robotic system.

In some embodiments, the body of a robotic system may be a small rigid ellipsoid, tear drop, ovular cylinder, partial ellipsoid, combinations of the forgoing, and/or any other suitable hydrodynamic shape for moving in aquatic environments. The body of the robot may be configured to be operatively connected to a rotatable mass. In certain embodiments, the rotatable mass may be positioned in an interior of the body such that the body surrounds the rotatable mass. Additionally, the body may be connected to a flexible fin by which thrust on the body may be produced. In certain embodiments, the flexible fin may be removably attached such that the fin may be easily installed or removed. For example, the fin may be connected with a loose interference fit, sliding fit, a removable fastener, or any other suitable arrangement. In other embodiments, the flexible fin may be permanently attached to the body using a tight press fit, adhesive, rivets, welds, or any other suitable attachment arrangement. The body interior may also be sealed to provide a waterproof compartment, such that electronic components may be housed inside of the body safely isolated from the surrounding aquatic environment. However, in some embodiments, the body may not be sealed to provide a waterproof compartment, such that the body interior is accessible to surrounding fluid. The body may accommodate a plurality of sensors, actuators, or attachments on the interior or an exterior of the body which may be used to perform a particular underwater mission.

In some embodiments, a rotatable mass operatively coupled to a body of a robotic system may be a reaction wheel driven by a motor which is used to generate a reaction torque in the body. Unlike in conventional swimming robots, the output of the motor is not connected to the flexible fin directly. Instead, the motor may be operatively coupled to the rotatable mass (e.g., flywheel, reaction wheel, etc.) which is able to freely spin inside of the body of the robotic system. During at least one operating mode, the motor is controlled such that the angular speed of the reaction wheel varies in time due to angular accelerations applied to the rotatable mass relative to the body. Changing the angular acceleration of the rotatable mass produces a reaction torque which causes the body of the robot to yaw, pitch, and/or roll depending on the orientation of the rotatable mass relative to the body. In cases where the angular acceleration is changed cyclically, the body may yaw, pitch, and/or roll back and forth in an oscillatory manner. The flexible fin may be attached to the exterior of the body such that the yawing, pitching, and/or rolling of the body induces elastic deformations along the length of the flexible fin which in turn creates thrust as the fin displaces the surrounding fluid as it returns to a non-deformed configuration. This approach may yield much higher swimming velocities than those of previous flexible swimmers while maintaining mechanical simplicity. The duration and magnitude of the reaction torques may be modified or controlled to perform a number of different maneuvers including aggressive swimming maneuvers such as sudden accelerations and turns.

To produce a propagating wave of deformations in a flexible fin, a rotatable mass may be cyclically accelerated in different rotational directions, such that an oscillatory reaction torque is induced in the body that causes the body to yaw, pitch, and/or roll back and forth. Accordingly, the motor connected to rotate the rotatable mass may receive a periodic signal to produce the oscillatory torque. The signal may be any periodic pattern suitable for causing an oscillatory reaction torque in the body, including but not limited to a sinusoid, sawtooth, triangle, square wave, or any other appropriate acceleration and/or speed pattern of the rotatable mass. In some embodiments, the motor may only spin in a single direction and accelerating or decelerating the rotatable mass may induce angular acceleration causing the oscillatory reaction torque. In other embodiments, the motor may spin in two directions, such that the rotatable mass is accelerated to spin in a first direction to induce a reaction torque and then accelerated to spin in a second direction to induce an opposite reaction torque, thereby creating an oscillatory reaction torque pattern that may generate a propagating elastic wave in the flexible fin.

Without wishing to be bound by theory, creating an elastic wave in a flexible fin that corresponds to a resonance mode of the flexible fin may increase the efficiency and/or speed of the propulsion of an associated robotic system. Accordingly, similar to the above, in some embodiments, a rotatable mass of a robotic system may be cyclically accelerated in different rotational directions to induce resonance in a flexible fin. The cyclical oscillation of the rotatable mass may create a cyclical reaction torque which rotates the body to displace an end of the flexible fin. Based on the flexural rigidity, length, and other characteristics of the flexible fin as well as the oscillatory frequency, an elastic wave may be induced in the flexible fin. However, in this embodiment, the cyclic deformations may be applied with oscillatory frequencies that are approximately equal to one or more resonant mode frequencies of the flexible fin which may increase the efficiency and/or speed of the robotic system. This may include applying oscillation frequencies that are approximately equal to a frequency of a first mode, a second mode, a third mode, and/or any other resonant mode of the flexible fin. The one or more resonant mode frequencies may also correspond with one or more resonant mode shapes of the flexible fin.

According to yet another embodiment, a flexible fin may be a thin elastic material with relatively low stiffness. For example, the flexible fin may be a thin polymer sheet such as polyethylene terephthalate glycol (PETG) plastic or any other suitable thin elastic material. Of course, any suitable shape with a suitable combination Young's modulus and moment of inertia capable of exhibiting the desired flexible elastic behavior may be employed, including, but not limited to, a shape with an ellipsoidal or any other appropriate cross sectional shape. Accordingly, the flexible fin may be elastically deformable, such that the sheet passively returns to an unbiased or unstressed configuration after an elastic deformation. The flexible fin may be attached to a body of a robotic system at a leading edge, or other appropriate portion, of the fin. Accordingly, this attached portion of the fin may move with the body. Therefore, as the body moves due to reaction torques or other forces, the attached portion of the fin will move with the body causing the flexible fin to deform into a biased state. Due to the nature of the flexible fin, the flexible fin will resist this deformation and passively return to an unstressed configuration. As the flexible fin returns to the unbiased configuration, surrounding fluid is moved, thereby generating thrust on the attached body through the fin. Propagating waves of these deformations may be generated by cyclically yawing, pitching, and/or rolling the body using a reaction torque, which generates consistent thrust to propel the body forward. Depending on the symmetry of the applied accelerations and resulting deformations of the fin, the robotic system may be controlled to execute different swimming maneuvers as defined further below.

Depending on the application, it may be desirable to vary the properties of a flexible fin along its length to control one or more performance characteristics of the fin. For instance, in some embodiments, a flexible fin may have a variable shape and/or exhibit variable dimensions along its length. For example, the height and/or width of the flexible fin may change from a proximal portion of the fin adjacent the body to a distal portion of the fin located opposite from the proximal portion of the fin attached to the body. In one embodiment, the proximal portion of the fin may be smaller in height than a distal portion of the fin. According to this embodiment, the fin may have a triangular plan shape where the fin has a maximum height at a distal most portion of the fin. In some embodiments, a maximum height of the flexible fin may be approximately equal to a maximum height of the body of the robotic system. In another embodiment, the proximal portion of the fin and the distal portion may have different widths. For example, the width at the proximal portion may be wider than the width at the distal portion. Additionally, in some embodiments, a flexible fin may have a rectangular cross-sectional shape at a proximal end and an elliptical cross-sectional shape at a distal end. Of course, the flexible fin may have any suitable shape and/or dimensions which may either be constant or variable along a length of the flexible fin including, but not limited to triangular, trapezoidal, or rectangular plan shapes as viewed within a vertical plane passing through a midplane of the robotic body. The flexible fin may also have rectangular or elliptical cross-sectional shapes, as the present disclosure is not so limited. However, it should be understood that any appropriate plan and/or cross sectional shape may be used as the disclosure is not so limited.

A flexible fin may be made of any appropriate combination of materials, shapes, and sizes such that the fin exhibits a suitable combination of Young's Modulus and moment of inertia to provide a desired flexural rigidity which allows the fin to efficiently deform and produce thrust from reaction torques applied to an associated body. Accordingly, in some embodiments, a flexible fin may be constructed to have a flexural rigidity between or equal to about $10^{-3}$ and $10^{-5}$ $N \cdot m^2$, $5 \times 10^{-4}$ and $5 \times 10^{-5}$ $N \cdot m^2$, or any other appropriate flexural rigidity. It should be understood, a fin may be made using any suitable material that is sufficiently elastic and flexible, including, but not limited to, low-density polyethylene plastics, rubber, or Teflon. Additionally, while particular materials and ranges of flexural rigidities are noted above the disclosure is not limited to only these materials and ranges. In some embodiments the Young's modulus and/or moment of inertia (i.e. a cross-sectional shape of the fin) may be varied along a length of the fin such that the flexural rigidity varies along a length of the fin. This variation in flexural rigidity along the length of a fin may help in controlling a shape of an elastic wave produced by the fin during operation. In other embodiments, the Young's modulus, moment of inertia, and/or cross-sectional area may be constant along the length of the fin such that the flexural rigidity remains constant along the fin. According to this embodiment, characteristics of the fin may vary along the length of the fin correspondingly so that flexural rigidity remains constant. For example, the Young's modulus may increase where cross-sectional area decreases or a height and width of a cross section of the flexible fin may be varied together so that a substantially constant flexural rigidity is provided throughout the length of the fin.

Without wishing to be bound by theory, a ratio between a length of a flexible fin and a length of a body rotating in response to reaction torques may affect the efficiency and amount of thrust produced from a reaction torque applied to the body. In some embodiments, the ratio of fin length to body length may be between or equal to about 1:1 and 3:1, 1.5:1 and 2.5:1, or any other appropriate ratio. For example, the fin length to body length ratio may be approximately 1.5:1, 1.75:1, 2:1, 2.25:1, or 2.5:1. Of course, the ratio of fin length to body length may be any suitable ratio including ratios both greater and less than those noted above such that a reaction torque applied to the body causes elastic deformation of the fin to propel a robotic system.

In one mode of operation, an angular acceleration of a rotatable mass may average to approximately zero such that the net thrust produced by a flexible fin is along a longitudinal axis of the robotic system. Thus, the robotic system may be propelled in a forward direction from the oscillatory torque without significant deviation from that direction. In another mode of operation, the oscillatory angular accelerations and resulting torques may have an average with a non-zero value, such that more torque is generated in a first direction than in a second direction. In such an arrangement, the non-zero average acceleration and resulting torques may cause a net thrust in a direction biased away from the longitudinal axis of the robotic system, such that the robotic system may turn or change directions. Accordingly, by varying the average angular acceleration of the rotatable mass, the robotic system may execute swimming maneuvers such as turning.

In some embodiments, a rotatable mass may also be used to improve the stability of a robotic system in one or more modes of operation. For example, the rotatable mass may act as a stability gyroscope, configured to resist external disturbances encountered in an aquatic environment, such as currents, waves, animals, etc. Without wishing to be bound by theory, keeping the rotatable mass at a non-zero angular velocity may allow the rotatable mass to passively resist forces that may change the orientation of the robotic system. According to these embodiments, the movement of the robotic system may be more consistent and easily controlled.

In some cases, it may be desirable for a robotic system to have passive stability in water, such that the robotic system passively returns to an equilibrium position. Additionally, it may be desirable for the robotic system to passively align with gravity or other external forces, such that the robotic system has an external reference frame from which to operate. Accordingly, in some embodiments, the rotatable mass may be disposed vertically below a center of mass of the robotic system when the robotic system is in an equilibrium position in water. Without wishing to be bound by theory, in such an embodiment the rotatable mass may improve roll and pitch stability by lowering the center of mass of the robotic system below a center of buoyancy of the robotic system, such that the robotic system is passively stable in an equilibrium position within water.

In some embodiments, a rotatable mass may be positioned relative to a body to reduce wasteful movement of the body on the side opposite an attached flexible fin as the body responds to reaction torques to induce deformation in the flexible fin. Accordingly, in certain embodiments, the rotatable mass may be positioned between a center of mass and/or a geometric center of the robotic system and a portion of the body opposite an attachment location of the at least one flexible fin. In some instances, it may be beneficial to increase the distance between the axis of rotation of the rotatable mass and the attachment location between the flexible fin and the body. Without wishing to be bound by theory, the increased distance between the rotatable mass and the attachment location of the flexible fin may improve the efficiency of the propulsion for a given reaction torque.

In some embodiments, a robotic system may further include a depth control system to adjust the depth of the robotic system. For example, the robotic system may include one or more actuatable fins that may be used to adjust the pitch of the robotic system. In this example, the vertical direction of the robotic system could be adjusted by actuating one or more fins to adjust an angle of attack of the fins relative to a direction of motion of the robotic system such that the thrust produced by the flexible fin causes the robotic system to change depth. In some other embodiments, the robotic system may include an adjustable ballast tank to adjust depth. For example, the robotic system may include a tank configured to be selectively filled or emptied with water to adjust the buoyancy of the robotic system. Accordingly, the tank may allow the robotic system to change depth by correspondingly increasing or decreasing the overall buoyancy of the robotic system. Of course, any suitable system or method for adjusting the depth may be employed, including, but not limited to, reaction wheels, thrusters, and propellants.

The disclosed robotic systems have many possible applications, including, but not limited to, long range sensing, mapping, inspection, and maintenance or repair of underwater structures. Additionally, the disclosed robotic systems may provide significant advantages in terms of agility, size, cost, and ease of manufacturing. While the capabilities of a single small underwater robot may be limited, the robotic system could be deployed in groups or large swarms to accomplish large tasks. In this application, the small size and low cost of the disclosed robotic system are particularly advantageous. Additionally, the flexible fin structure of the disclosed robotic system may make it possible to pack groups of the robotic systems into conventional AUVs. The conventional AUV could deliver the group of robotic systems to a desired location and deploy them to act as a cooperative underwater swarm for mapping and sensing missions. Many direct applications for the disclosed invention exist within the oil and defense industries among others. Examples of direct applications include port-security, offshore platform inspection, and subsea weapons detection.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 depicts one embodiment of a robotic system 100. The robotic system includes a body 102 and a flexible fin 104 coupled to the body at a fin attachment location 114. The flexible fin 104 is composed of an elastic material and is configured to deform in response to rotation of the body 102 relative to an environment, e.g. a surrounding fluid medium such as water, that the body and flexible fin are located in. That is, the body is configured to rotate upon activation of an actuator (e.g., a rotatable mass) to deform the flexible fin due to forces applied to the flexible fin by the fluid medium that resist movement of the fin as the body is rotated. As the flexible fin returns towards a resting configuration from the deformed configuration, a thrust is applied to the flexible tail and body due to displacement of the fluid medium. As shown in FIG. 1, the flexible fin is in a deformed configuration where a wave is propagating down a length of the fin as the fin returns to the resting position which in some embodiments is a flat planar configuration of the fin. The body may also 102 also include one or more stabilizer fins 116 which are configured to stabilize the robotic system as the body moves through a fluidic medium such as water. In this particular embodiment, the stabilizer fins extend outwards from the body in a lateral direction that is perpendicular to a direction in which the flexible fin extends outwards from the body when in the resting or unflexed configuration. According to the embodiment shown in FIG. 1, the stabilizer fins are not actively controlled and resist rotation of the body in pitch (i.e., rotation about the y-axis) and roll (i.e., rotation about the x-axis) directions. However, embodiments in which the stabilizer fins are displaceable and/or rotatable relative to an axis to provide some amount of pitch and/or roll control are also contemplated. As also shown in FIG. 1, in certain embodiments, a robotic system may also include one or more indicators 130, such as an LED array, which may be configured to convey various types of information to an operator of the robotic system and/or to function as imaging points to help with tracking and imaging of a robotic system.

As shown in FIG. 1, a vertical or z direction relative to a robotic system may correspond to a direction that is aligned with a direction of gravity when the robotic system is supported on a flat level surface or when the robotic system is in an otherwise properly righted neutral position. This vertical or z direction may also be perpendicular to a direction in which a flexible fin extends away from a body of a robotic system. A longitudinal or x direction may refer to a direction that extends in a fore aft direction of the robotic system from a forward portion of the robotic body towards a distal end of a flexible fin attached to the body. The flexible fin may also extend in this longitudinal or x direction. Correspondingly, a horizontal, lateral, or y direction may refer to a direction that is orthogonal to both the vertical/z direction and the longitudinal/x direction which may correspond to a direction that is parallel to an underlying surface when the robotic system is supported on that surface and/or when the robotic system is otherwise in a properly righted neutral position.

Figure 2:
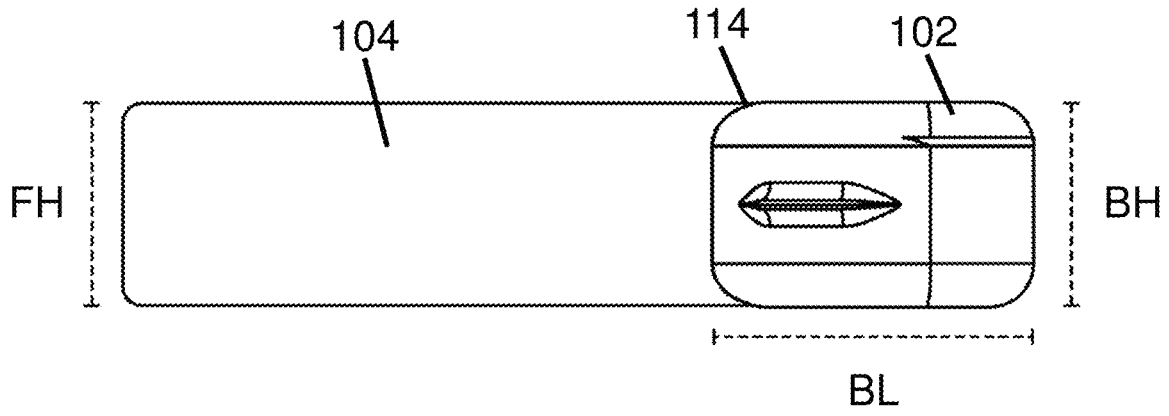
FIG. 2 depicts a side view of the robotic system of FIG. 1.
Figure 3:
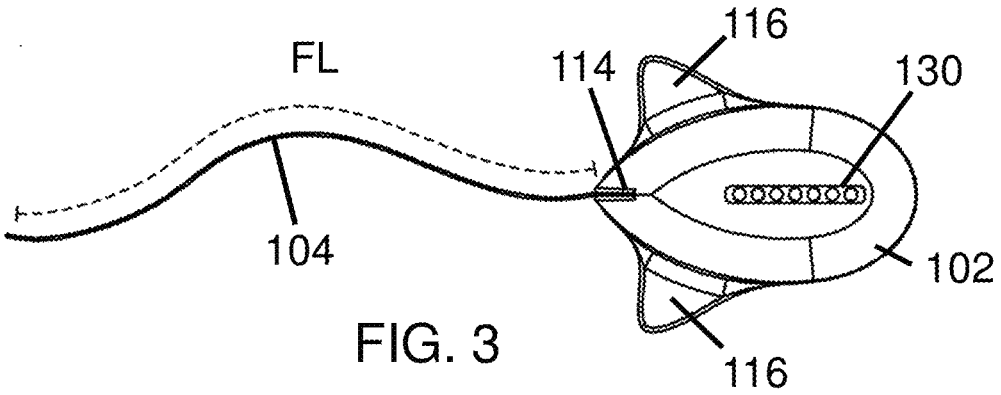
FIG. 3 depicts a top view of the robotic system of FIG. 1.
Figure 4:
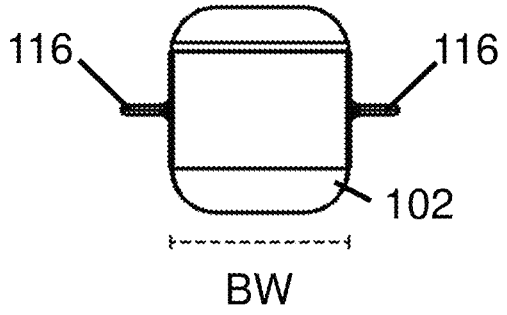
FIG. 4 depicts a front view of the robotic system of FIG. 1.

FIGS. 2-4 depict alternative views of the robotic system of FIG. 1. As best shown in the side view of FIG. 2, the flexible fin 104 is configured in a rectangular shape, where the height FH of the fine remains constant along the length of the fin. The body 102 has a body height BH which is approximately equal to the height FH of the fin. Accordingly, there is a smooth transition in height at the fin attachment location 114 between the body and the fin. However, embodiments, in which the body and fin heights are different are also contemplated. The body has a body length BL which may be selected in combination with the body height and overall body shape such that the body is constructed to house at least one actuator (e.g., a rotatable mass), controller, power source, and, in some embodiments, a payload such as one or more sensors, tools, or other appropriate component determined by the particular mission parameters. As best shown in the top view of FIG. 3, the flexible fin 104 may be relatively thin as compared to a width (see FIG. 4) of the body 102. The fin extends from the body a length FL which as noted previously may be longer than a length of the body BL. As shown in the front view of FIG. 4, the body 102 has a body width BW which may be wider that the width of the fin. Again, in some instances, one or more stabilizer fins 116 may be coupled to the body such that they are thin features that project out in a transverse direction from the body (i.e., in a direction of the body width) to passively stabilize the rotation of the body in the pitch and/or roll directions.

Figure 5:
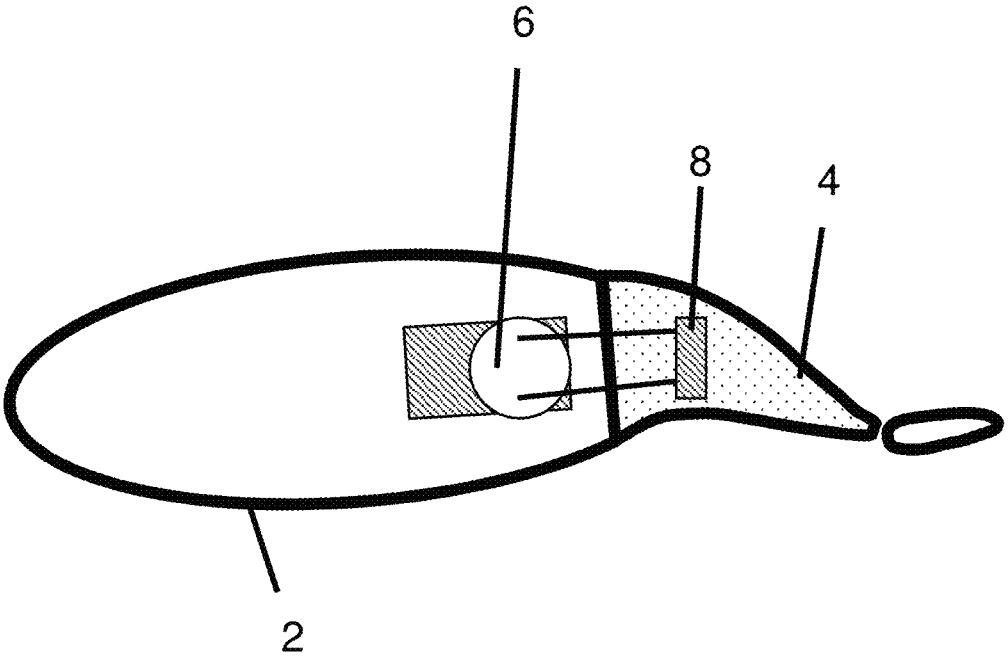
FIG. 5 (Prior Art)
FIG. 5 depicts a top cross-sectional view of a representative prior art robotic fish.

FIG. 5 depicts a top cross-sectional view of a representative prior art robotic fish. The robotic fish includes a body 2 attached to a flexible fin 4. The robotic fish also includes a servo 6 coupled to the fin by a linkage 8. As shown in the figure, actuation of the servo 6 directly moves and flexes the flexible fin 4, thereby creating thrust for the robotic fish. Such a system is difficult and expensive to produce, as the linkage 8 must be formed inside of the flexible fin 4. Additionally, the linkage 8 introduces mechanical complexity that increases the chance of mechanical failure of the robotic fish. For example, impact damage to the flexible fin 4 may break or damage the linkage 8, thereby disabling the robotic fish completely.

Figure 6:
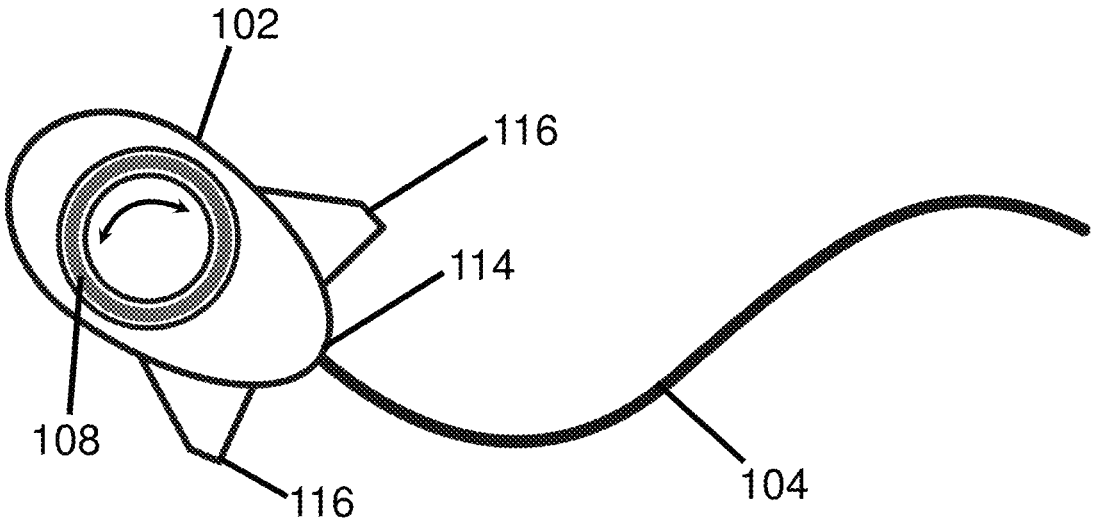
FIG. 6 depicts a top cross-sectional view of a robotic system according to another embodiment.

FIG. 6 depicts a top cross-sectional view of a robotic system according to one embodiment. The robotic system includes a body 102 attached to a flexible fin 104 at attachment location 114. The robotic system further includes a rotatable mass 108 operatively coupled to the body 102 and configured to accelerate and/or spin in two opposing rotation directions (as shown by the arrows in the figure). This angular acceleration of the rotatable mass causes a reaction torque in the body 102. The reaction torque causes the body 102 to yaw about the axis of the rotatable mass. As the body 102 yaws, the portion of the flexible fin 104 attached to the body moves with the body 102. Due to the elastic and flexible nature of the fin 104, the flexible fin 104 is deformed from a resting straight (i.e., unstressed) configuration to a flexed (i.e., biased) configuration. The flexible fin 104 then returns to the unstressed or resting configuration, moving the surrounding fluid. This movement of fluid by the flexible fin is translated into thrust for the robotic system which propels the system forward.

According to the present embodiment, the rotatable mass 108 may be operatively coupled to a motor (see FIG. 7) 106 which is attached to the body 102, such that the motor accelerates the rotatable mass 108 in two opposing rotational directions. In some embodiments, the motor may be a brushless motor. However, any suitable motor for accelerating the rotatable mass may be employed. By changing angular acceleration of the rotatable mass 108, the brushless motor induces reaction torques in the body 102 and creates the forward thrust as described above. In at least one mode of operation of the robotic system, the motor induces a cyclic change in the angular acceleration of the rotatable mass 108 between a first direction of rotation and a second direction of rotation. Thus, the body 102 is cyclically yawed back and forth which in turn induces a propagating elastic wave in the elastic fin 104. In some modes of operation, the rotatable mass 108 is spun in a constant direction of rotation, and is then either accelerated or decelerated in the constant direction of rotation to produce the cyclic change in the angular acceleration applied in the first and second directions. In one mode of operation, the average angular acceleration between the first direction and the second direction is zero, such that the propagating wave is symmetrical. In this mode, the net thrust produced by the flexible fin 104 may be aligned along a longitudinal axis of the body, such that the robotic system may move directly forward. In some other modes of operation, the average angular acceleration between the first direction and second direction may be non-zero, such that an asymmetric wave is induced in the flexible fin 104. In these modes, the net thrust produced by the flexible fin 104 may not be aligned to the longitudinal axis of the body, but rather biased to a first side of the body or a second side of the body, such that the robotic system turns toward the first or second side. Thus, using a non-zero average of angular acceleration in at least one operational mode, the robotic system may be able to turn or otherwise navigate using the flexible fin 104.

Figure 7:
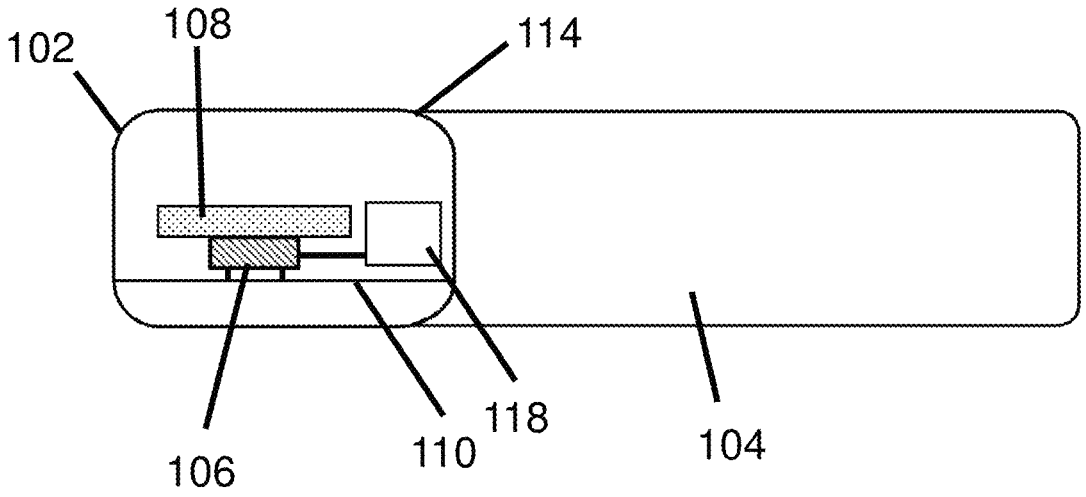
FIG. 7 depicts a side schematic side cross-sectional view of the robotic system of FIG. 6.

FIG. 7 depicts a side schematic view of the robotic system of FIG. 6. As described above, the robotic system may include a body 102 attached to a flexible fin 104. The system further may include a rotatable mass 108 operatively coupled to the body 102 through a motor 106 which is attached to the body, and which in some embodiments is a brushless motor. Of course, any suitable actuator that is able to apply angular acceleration in the rotatable mass 108 and transfer a reaction torque to the body may be employed as the present disclosure is not so limited. The flexible fin 104 is attached to the body along an attachment location 114, such that a leading edge of the fin 104 moves in conjunction with the body 102. The robotic system may also include a controller 118 that is operatively coupled to the motor to control a direction of rotation as well as the angular accelerations commanded by the motor to accelerate and spin an associated rotatable mass. It should be understood that the controller may correspond to any computing device capable of appropriately controlling operation of the motor and associated rotatable mass.

As shown in the figure, a body 102 may include a barrier 110 which is attached to the motor 106 and body to operatively couple the rotatable mass 108 to the body 102. For example, the barrier 110 may provide a stable platform for mounting the motor 106 relative to the body. A rotation axis of the motor 106 and/or rotatable mass 108 may be aligned and/or substantially parallel with one of the principle axes of the body (i.e., pitch, yaw, or roll). Additionally, the motor and rotatable mass may be attached to the barrier 110, or other appropriate attachment point, to align the rotation axis of the rotatable mass 108 in a direction corresponding to the vertical axis (i.e., a direction parallel to a height) of the flexible fin. Without wishing to be bound by theory, the angular acceleration and reaction torques in the body may cause the flexible fin 104 to deform in a single axis in the transverse direction (i.e., a direction of thickness or width) of the fin and/or body, thereby resulting in thrust on the body in a horizontal plane with little to no vertical component. While in the present embodiment the rotatable mass 108 is aligned with a vertical axis of the flexible fin, the rotatable mass 108 may be oriented in any suitable direction such that angular acceleration of the rotatable mass 108 causes a flexible fin 104 to deform in a desired direction.

Figure 8:
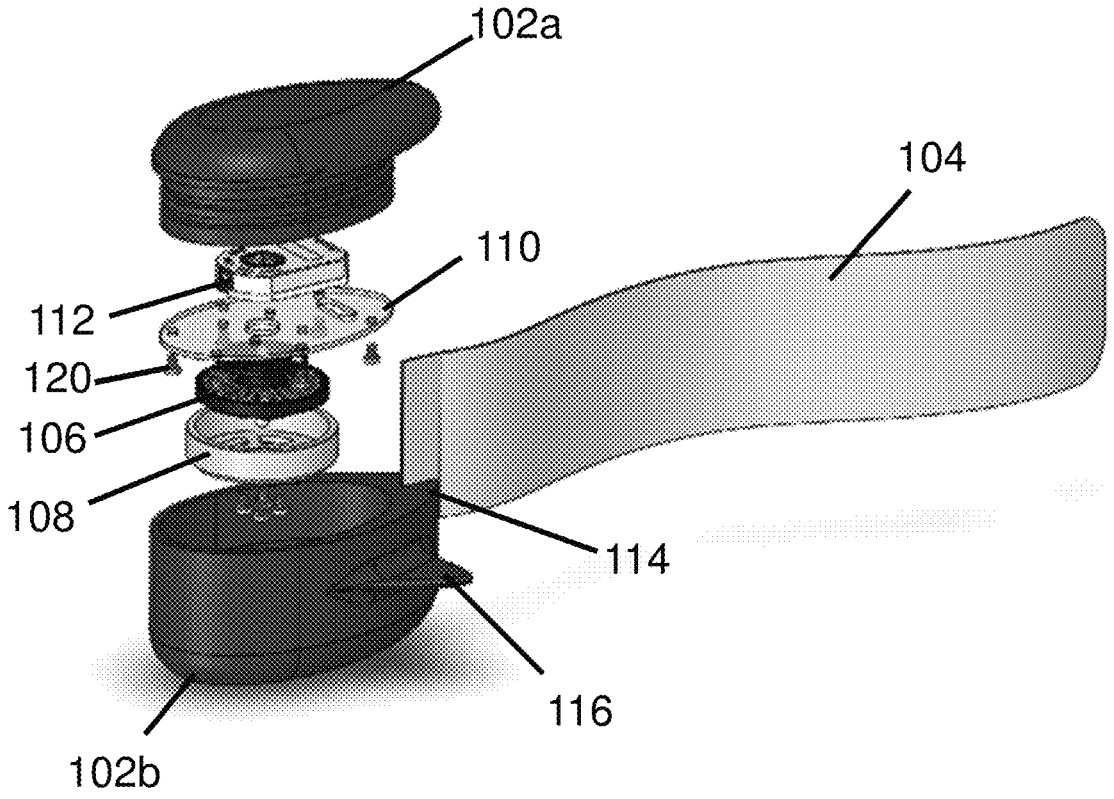
FIG. 8 depicts an exploded perspective view of a robotic system according to one embodiment.

FIG. 8 depicts an exploded perspective view of a robotic system according to one embodiment. The robotic system includes a body with upper and lower portions 102*a*, 102*b* attached to a flexible fin 104 and operatively coupled to a rotatable mass 108. In this embodiment, the body is split into an upper portion 102*a* and a lower portion 102*b* such that the body can be easily assembled or disassembled to access or mount the various components. The upper portion 102*a* and lower portion 102*b* of the body may mate to form an interior cavity that may house other components of the robotic system. The body 102*a*, 102*b* of the robot may be waterproofed using low viscosity epoxy resin. Of course, the body may be made using any suitable material and/or method, and may be waterproofed, or not, using any appropriate method. The body 102*a*, 102*b* may include a removably attached barrier 110 or other mounting component, such as a plate disposed in and matching a shape of an internal cavity of the body, which may be used for mounting various components inside the body and allowing the components to be easily inserted or removed from the body. The barrier may be removably attached to the body using one or more fasteners 120 shown here as machine screws. However, embodiments, in which a different mounting structure disposed within a cavity of the body, and/or in which one or more components are attached directly to the body of the robotic system, are also contemplated as the disclosure is not so limited. Additionally, in some embodiments, the body may include a one or more stabilizer fins 116 as previously described which may be integrally formed with, and/or attached to, the body for additional pitch and/or roll stability.

As shown in the figure, the fin 104 is connected to the body 102*a*, 102*b* at an attachment location 114 configured as a press fit slot. According to this embodiment, the fin may be swapped out for replacement or maintenance. Other fins may employ different sizes and materials with different elastic properties depending on the particular thrust and agility characteristics desired for a mission profile. Thus, the fin 104 may be easily switched with another to attain different swimming characteristics that may be useful for certain mission profiles.

According the depicted embodiment, the rotatable mass 108 may be operatively coupled to a motor 106 shown here as a brushless motor. The motor 106 may be coupled to the barrier 110 in an inverted orientation, such that the rotatable mass 108 is near the bottom of the body 102*a*, 102*b* and below a center of mass of the robotic system when a robotic system is in an equilibrium position within water. By positioning the rotatable mass 108 below a center of mass of the system, the overall center of mass may be lowered below a center of buoyancy. Thus, in some embodiments the robotic system may be passively stable in the pitch and roll directions, as the center of buoyancy is above the center of mass, causing the robotic system to passively self right itself to an upright position. While in the depicted embodiment the rotatable mass is positioned below a center of mass of the robotic system, the rotatable mass may be positioned in any suitable location such that angular acceleration of the rotatable mass causes deformation of a flexible fin.

As shown in the depicted embodiment, the rotatable mass 108 may be further aligned with the yaw axis of a robotic system, and accordingly angular acceleration of the rotatable mass 108 may cause a yawing motion from a reaction torque applied to the body 102*a*, 102*b*. The flexible fin 104 may also aligned be with the yaw axis of the robotic system, such that the yawing motion of the body 102*a*, 102*b* causes the flexible fin to deform in the same direction. Accordingly, as the flexible fin 104 returns to a resting non-deformed position, thrust is generated on the robotic system in a direction in a horizontal (i.e. lateral) plane with a negligible vertical component to the thrust.

In some embodiments, the angular acceleration of a rotatable mass 108 may cyclically change between a first direction of rotation and a second direction of rotation in at least one mode of operation. In some modes of operation, the rotatable mass 108 is spun up in a first direction of rotation with a non-zero average angular velocity, whereby increasing the velocity causes angular acceleration in the first direction and decreasing the velocity causes angular acceleration in the second direction. In other modes of operation, the rotatable mass 108 oscillates between being rotated in the first direction and being rotated in the second direction to cause angular acceleration in the corresponding directions of rotation, such that the rotatable mass has an average angular velocity of zero. According to these modes of operation, the angular acceleration of the rotatable mass 108 may cause an equal and opposite reaction torque in the body 102*a*, 102*b* to cause yawing motion which produces thrust from the flexible fin 104 as described above. Additionally, by cyclically oscillating the angular acceleration, a propagating wave of elastic deformation may be produced in the flexible fin 104, thereby producing forward thrust along an approximately longitudinal axis of the body. For thrust along an approximately longitudinal axis of the body 102*a*, 102*b*, the average angular acceleration may be approximately zero, such that a symmetric elastic wave is produced in the flexible fin 104.

In some modes of operation, a rotatable mass 108 may have a non-zero average of angular acceleration, such that the produced reaction torques are biased to one of a first direction of rotation and a second direction of rotation. For example, the angular acceleration of the rotatable mass 108 may be greater in at least one of magnitude and duration in a first direction of rotation than in a second direction of rotation. Thus, the body 102*a*, 102*b* may move more in one of the first rotation direction and second rotation direction. Accordingly, an asymmetric elastic deformation may be formed in the flexible fin 104. As the fin 104 is asymmetrically deformed, the thrust produced will be biased to one side of the longitudinal axis in the lateral (i.e., horizontal) plane, such that the robotic system is able to change direction and turn. Depending on the magnitude or duration of the non-zero average of angular acceleration, the turn may be tighter or more rapid such that aggressive swimming maneuvers can be performed. In some modes, the non-zero average may be small in magnitude, such that slow maneuvers such as broad sweeping turns may be performed.

As shown in the depicted embodiment, the robotic system may further include a rotary encoder 112 which is appropriately coupled with the motor 106. The rotary encoder which may enable feedback control of the motor 106. In some embodiments, the robotic system may include a controller (not shown in the figure) used to control the speed of the motor 106 with a control signal. A periodic signal may be employed in one or more modes of operations to generate the control signal that cyclically operates the motor to produce an oscillating angular acceleration. For example, the controller may use at least one of a sinusoid, square, triangle, and/or sawtooth wave patterns to induce oscillatory motion in the body using the motor 106 and rotatable mass 108. Of course, any suitable control signal pattern may be employed to induce the oscillatory angular acceleration of the rotatable mass 108 as described above. The rotary encoder 112 may be used in a feedback control scheme to modify the control signal and account for environmental disturbances encountered in an aquatic environment like the ocean. For example, the controller may use feedback from the rotary encoder 112 for use in PID control or any other suitable feedback control mechanism such that the direction and speed of the robotic system may be reliably controlled by the controller. In some embodiments, the upper portion of the body 102*a* may house one or more batteries or other suitable power sources (not shown in the figure) for powering the motor 106, the rotary encoder 112, and the controller.

In some embodiments, a flexible fin of a robotic system may have a substantially planar shape that is substantially parallel to a pitch axis of a body of the robotic system, such that thrust produced from the vertical fin is in the vertical and longitudinal directions. For example, a fine may extend in a longitudinal direction away from a body of a robotic system and the fin may have a width dimension that is greater than a height dimension as discussed herein. In this embodiment, the rotatable mass may be similarly oriented parallel, and in some embodiments coaxially, with the pitch axis of the body of the robotic system, such that angular acceleration of the rotatable mass causes the body to pitch from a reaction torque. As the rotatable mass is oscillated with an average angular acceleration of approximately zero, a symmetric propagating elastic wave forms in the flexible fin to propel the robotic system forward along the longitudinal axis of the system. If the rotatable mass is oscillated with an average angular acceleration that is non-zero, an asymmetric propagating elastic wave is generated in the flexible fin, thereby biasing the thrust produced vertically above or below the longitudinal axis of the robotic system. Accordingly, by using a non-zero average angular acceleration of the rotatable mass, the robotic system may turn in the vertical direction, thereby adjusting the depth of the system using thrust from the fin. In this embodiment, a yawing system may be employed, such as a rudder or actuatable fins. The rudder or actuatable fins could be used to induce lift or drag on one side of the robotic system, causing the robotic system to turn in the horizontal plane (i.e., yaw). Thus, by using a fin oriented along a pitch axis, the robotic system may be controllable to move vertically and laterally without use of a ballasting system or other depth adjustment systems.

In view of the above, it should be understood that flexible fins and associated rotatable masses may be appropriately oriented and connected relative to an associated body of a robotic system to provide any desired combination of thrust in a pitch, roll, and/or yaw direction as the disclosure is not limited to any particular orientation of these components relative to a robotic system.

When startled, fish exhibit a characteristic escape response known as a C-Start. During a C-Start, a fish curls its body into a C-shape and then rapidly uncurls to generate a burst of propulsive force with its fin. Fish have been observed to reach accelerations as high as 200 $m/s^2$ during these types of swimming maneuvers. Accordingly, it may be desirable for a robotic system to replicate the efficacy of this motion. In some embodiments, a robotic system may execute a C-start by suddenly accelerating the internal reaction wheel to its maximum rotational speed. This action produces a reaction torque in the body which causes the robot to curl up, with the uncurling motion that produces the thrust being generated by the flexible fin's elastic response. In contrast to previous systems that have attempted a C-start, the disclosed robotic system is capable of much more rapid and effective C-start maneuvers.

Figure 9:
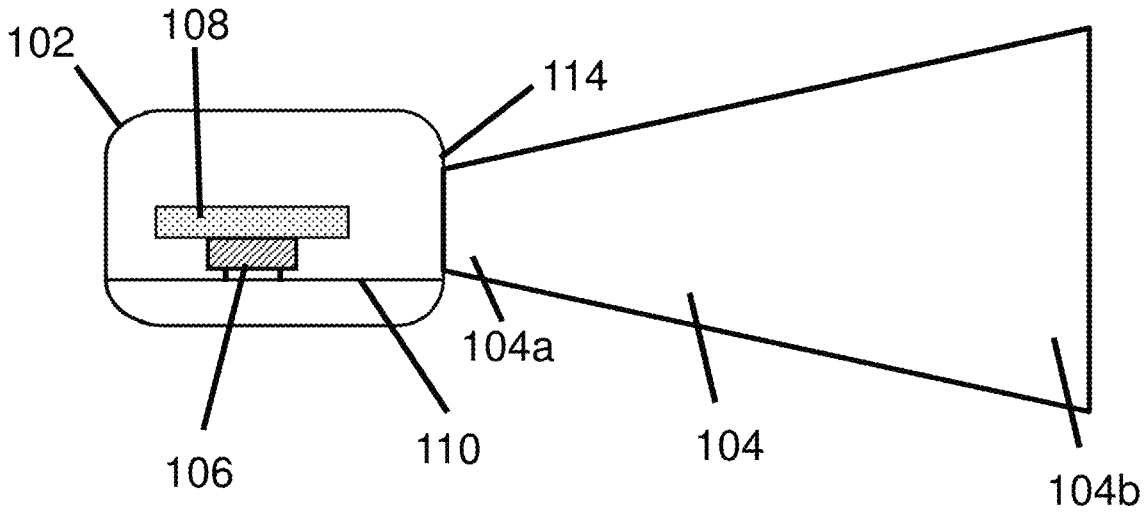
FIG. 9 depicts a side schematic cross-sectional view of a robotic system according to another embodiment.

In some embodiments, it may be desirable to vary the characteristics of a flexible fin along its length to alter the response characteristics of a robotic system. FIG. 9 depicts a side schematic view of a robotic system according to one such embodiment. Similar to the embodiment of FIG. 7, the robotic system includes a body 102 housing a motor 106 coupled to a rotatable mass 108. The motor is connected to the body via a barrier 110 or other appropriate connection structure. However, in this embodiment, the flexible fin 104 connected to the body at fin attachment location 114 has a shape that changes along its length. Specifically, a height of the fin increases along its length to form a fin with a triangular shape or a trapezoidal shape along a longitudinal plane of the robotic system corresponding to a vertical plane passing through the midplane of the robotic body. In the depicted embodiment, the smaller end of the fin is attached to the body. That is, the height of the flexible fin at a proximal portion 104*a* may be less than the height of the fin at a distal portion 104*b*. Accordingly, the fin has a gradient in height along its length. Without wishing to be bound by theory, such an arrangement may increase the thrust generated by the fin and/or the efficiency of the fin, as the increased dimension, which in this case is height, at the distal portion of the fin may enable increase the thrust generated by the tail for a given input. Accordingly, for two fins with approximately equivalent plan areas and corresponding drags, a fin with increased plan area located along a distal portion of the fin may generate increased thrust.

It is noted that changing the dimensions of a fin along its length may affect the flexural rigidity of the fin if no other parameters are considered. While the flexural rigidity of the fin may vary along its length in some embodiments, in other embodiments, a flexural rigidity of the fin may be substantially constant along its length. For example, in some embodiments, the flexible fin may correspondingly vary in thickness along its length to compensate for changes in the height, and vice versa, to provide a substantially constant flexural rigidity along a length of the fin. In one such example, the fin may be thicker in the proximal portion 104*a* and thinner in the distal portion 104*b* (e.g., see FIG. 12). Of course, the robotic system may have any suitable shape and dimensions, as the present disclosure is not so limited. Additionally, changes in material stiffness along a length of the flexible fin may also be used in combination with changes in a shape of the fin to provide a substantially constant flexural rigidity along a length of the fin. Material stiffness may be changed along a length of the fin using composite structures, changes in material treatments/additives, and/or any other method for controlling a stiffness of the structure. Accordingly, it should be understood that the current disclosure is not limited to any particular method of providing the desired flexural rigidity of a fin along its length.

Figure 10:
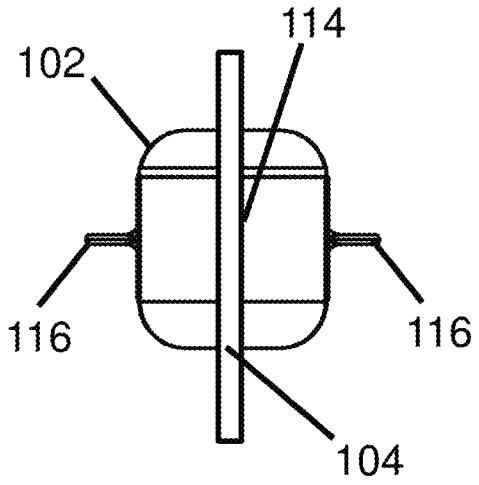
FIG. 10 depicts a back schematic view of a robotic system according to yet another embodiment.
Figure 11:
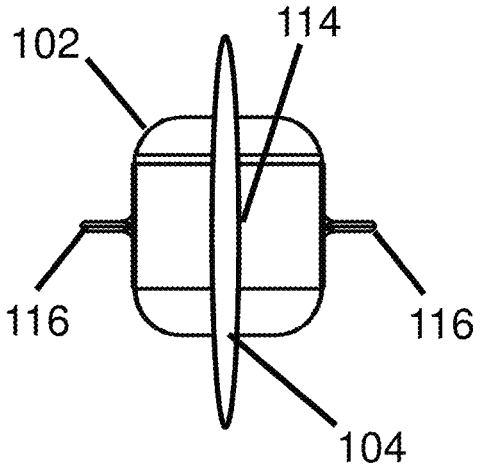
FIG. 11 depicts a back schematic view of a robotic system according to still yet another embodiment.

FIGS. 10-11 depict back schematic views of two different embodiments of a robotic system. The robotic systems each include a body 102 and a flexible fin 104 which is connected to the body at a fin attachment location 114. Stabilizer fins 116 project in a transverse direction from the body to provide stabilization in fluid mediums as discussed previously. As shown in FIG. 10, the flexible fin 104 has a rectangular cross-sectional shape taken along a plane that is perpendicular to a longitudinal direction in which the fin extends. Such an arrangement may improve manufacturability and increase robustness of the fin connection with the body. In contrast, the flexible fin shown in FIG. 11 has an elliptical cross-sectional shape. The elliptical cross-sectional shape may improve thrust generation, improve efficiency, or otherwise alter the flexural rigidity of the flexible fin. In some embodiments, a flexible fin may change between a rectangular, elliptical, or other cross-sectional shape to vary the characteristics of different portions of the fin (e.g., proximal portions and distal portions). For example, the fin may have a rectangular cross-sectional shape along a proximal end and/or portion of the fin to improve the connection between the fin and the body and have an elliptical cross-sectional shape along a distal portion to improve thrust generation. Of course, the flexible fin may have any suitable cross-sectional shape which may either be constant and/or variable along a length of the fin as the present disclosure is not so limited.

Figure 12:
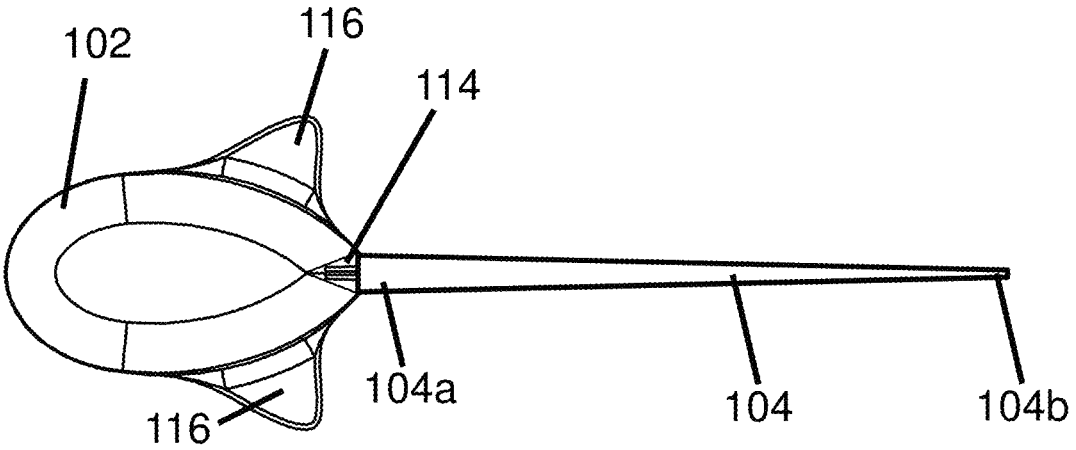
FIG. 12 depicts a top view of a robotic system according to still yet another embodiment.

FIG. 12 depicts a top cross-sectional view of a robotic system according to still yet another embodiment. As shown in FIG. 12 and similar to previously described embodiments, the robotic system includes a body 102 with stabilizer fins 116 and a flexible fin 104 connected to the body at fin attachment location 114. According to the depicted embodiment, the flexible fin varies in thickness along the length of the fin. That is, a proximal portion of the fin 104*a* has a larger thickness than a distal portion 104*b* of the fin. Such an arrangement may vary the flexural rigidity of the fin based at least partially on the thickness gradient along the length of the fin. As described previously, in some embodiments, the thickness gradient may be selected in coordination with the other properties of the fin including for example, overall shape and/or material rigidity, to provide either a variable or constant flexural rigidity of the fin along its length.

Figure 13:
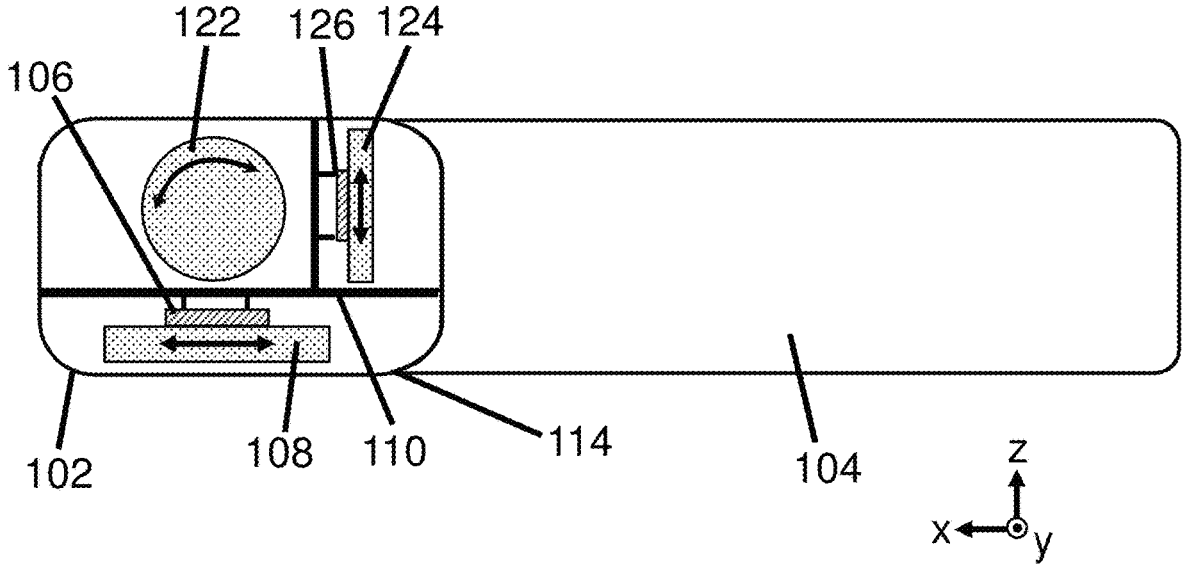
FIG. 13 depicts a side schematic view of a robotic system according to still yet another embodiment.

In some embodiments, it may be desirable to apply rotational torques and motions to a robotic system in two, three, or any appropriate number of directions. For example, a robotic system may control movement of a body of a robotic system in a pitch, yaw, and/or roll direction using two, three, or any appropriate number of rotatable masses. One such embodiment is depicted in FIG. 13 which illustrates a side schematic view of a robotic system according to still yet another embodiment. Similar to previously described embodiments, the robotic system includes a body 102 and a flexible fin 104 connected to the body at a fin attachment location 114. Inside the body are a motor 106 and a first rotatable mass mounted to the body via an appropriate connection such as by a barrier 110. As previously described, the first rotatable mass is configured to generate a reaction torque in the body as a result of angular acceleration of the first rotatable mass. Specifically, the first rotatable mass rotates about the z-axis to cause yawing motion of the body. In some embodiments, a second rotatable mass 122 is mounted to a second motor (not shown) and operatively coupled to the body. The second rotatable mass is configured to rotate parallel to a pitch or y-axis of the body to cause a pitching motion of the body. The robotic system may also include a third rotatable mass 124 coupled to a third motor 126 which is operatively coupled to the body. The third rotatable mass is configured to rotate parallel to a roll axis or x-axis of the body to cause a roll motion of the body. The various rotatable masses may be oriented so that the rotatable masses rotate about axes that are orthogonal to one another. However, embodiments in which the rotatable masses rotate about axes that are not orthogonal to one another are also contemplated.

In view of the above, in the embodiment shown in FIG. 13, the body may be controlled to rotate in any of the pitch, roll, and yaw directions. Such an arrangement may be beneficial to allow the body and flexible fin to be oriented in any desired direction in 3-dimensional space to control the direction of thrust of the robotic system. In some embodiments, only the first and second rotatable masses may be employed in a robotic system. That is, the body may be controllable in the pitch and yaw directions. In such an embodiment, the robotic system may be passively stable in the roll direction (e.g., by arranging the center of mass below the center of buoyancy). Thus, such an arrangement may allow the robotic system to control depth, generate thrust, and change direction while reducing mechanical complexity. However, embodiments in which any combination of the depicted rotatable masses and motors are used, and/or in which masses and/or motors oriented in different directions are used, are also contemplated as the disclosure is not limited to the use of rotatable masses and motors oriented in the specifically depicted directions.

While a particular arrangement and method for controlling the orientation and thrust of a robotic system in various directions is described above, the disclosed flexible fins and methods of operation may be used with other orientation and movement control methods as well. For example, in some embodiments, a robotic system may include active stabilizer fins, an actively controlled buoyancy system, or any other suitable arrangements for controlling the robotic system in more than one direction in addition to the disclosed flexible fins and methods of operations. That is, in cases where the robotic system includes a rotatable mass configured to rotate about the z-axis to cause yawing motion of the robotic system, it may be desirable to control the robotic system direction in pitch or otherwise adjust the depth of the robotic system. For example, actively controlled stabilizer fins disposed on the body of the robotic system may be used to adjust the pitch of the robotic system as thrust is generated, so that the stabilizer fins may be oriented at an appropriate angle of attack relative to the direction of thrust to provide a desired vertical force to change a depth of the robotic system. As another example, a buoyancy system may alter the balance of mass and buoyancy forces so that the robotic system moves in the z-direction (i.e., depth direction) while maintaining a level position. In this example, the robotic system may have a mass and buoyancy distribution such that the body maintains a resting position and is returned to that position when disturbed. That is, the center of gravity of the robot may be positioned below a center of buoyancy, so that the body returns to a resting position when an external disturbance induces roll and/or pitch. Of course, the robotic system may have any suitable construction for adjusting a depth and/or thrust direction of the robotic system, as the present disclosure is not so limited.

Figure 14:
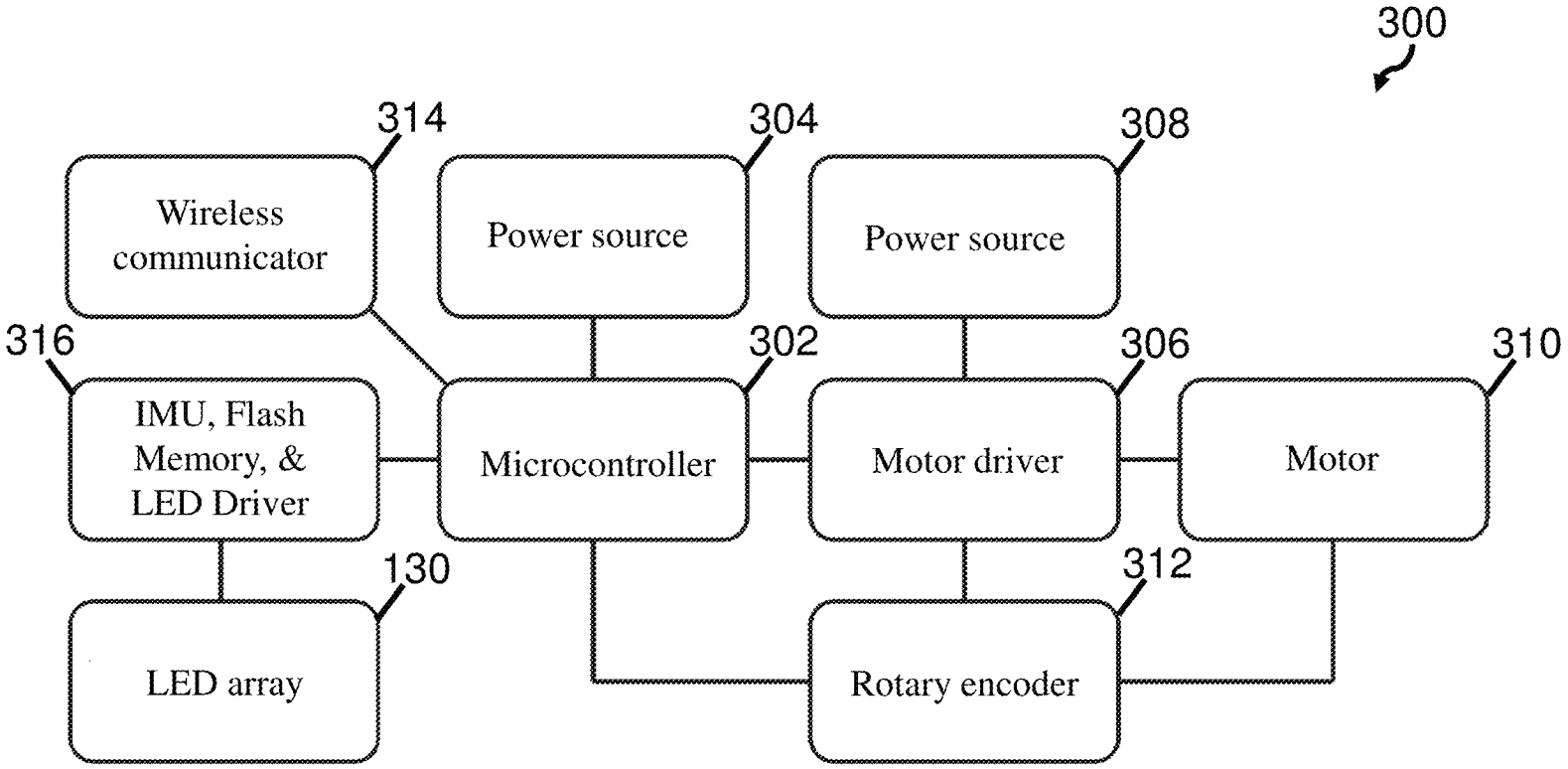
FIG. 14 depicts a block diagram of one embodiment of a control system for a robotic system.

FIG. 14 depicts a block diagram of one embodiment of a control system 300 for a robotic system. The control system shown in the figure is configured to control a robotic system including a rotatable mass oriented to create a reaction torque in a body of the robotic system which moves the body in a yawing or other appropriate direction. The control system includes a microcontroller 302, or other appropriate controller, a first power source 304, a motor driver 306, and a second power source 308. The first and second power sources, which may be any appropriate power source including batteries, fuel cells, capacitors, atomic batteries, and/or any other appropriate power source, may provide power to the microcontroller, motor driver, and/or the motor. The microcontroller and motor driver are configured to cooperate to control a motor 310 of the robotic system. That is, the microcontroller and motor driver control the motor to rotate the rotatable mass, for example, in an oscillatory manner at a predetermined frequency. A rotary encoder 312 is included in the control system to provide feedback control to the motor driver and/or microcontroller. For example, the rotary encoder may provide angular velocity or acceleration information to the microcontroller so that a reaction torque generated by the rotatable mass is controllable. The control system also includes a wireless communicator 314, such as a Wi-Fi, radio, Bluetooth, or other appropriate wireless communicator, that is configured to allow the microcontroller to communicate with an external computer or network. According to the embodiment shown in FIG. 14, the control system may also include an LED driver 316 configured to control an LED array 130 (for example, see FIG. 1).

Figure 15:
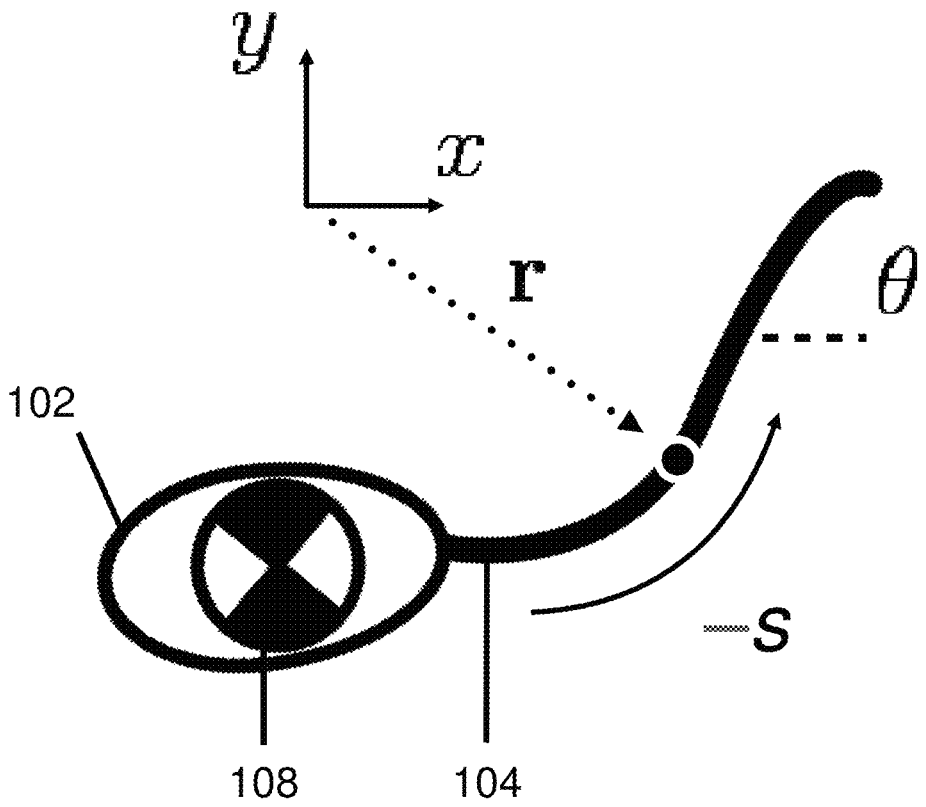
FIG. 15 depicts a model of a robotic system according to one embodiment.

FIG. 15 depicts a graphic of a robotic system used to develop a model of the system performance. The model predicts the interaction between the robots flexible structure and the surrounding fluid to calculate beneficial values for the dimensions and flexural rigidity of the flexible fin 104. The model consisted of large-amplitude Euler-Bernoulli beam theory coupled with a fluid force model based on slender-body theory. The model accounts for the interaction between the elastic tail fin and the surrounding fluid flow as well as the dynamics of the ellipsoidal body 102 and rotatable mass actuation system 108 of the robotic system. The constitutive equations of the model may be solved to determine the movement and deformation of the robot's structure, r(s), for a given set of design parameters and reaction wheel actuation patterns. With the modeled deformation and material properties of the body and flexible fin, the magnitude and direction may be computed for informing control schemes employed in the robotic system. Accordingly, the swimming performance of the robotic system can be accurately predicted as shown in the provided graphs below. Using the model, a desired flexural rigidity of a flexible fin was calculated to be roughly one order of magnitude lower than the flexural rigidity of conventional swimming robotic systems. Additionally, the model showed that flexible fin lengths corresponding to large portions of the robot's total length exhibited increased performance.

Figure 16:
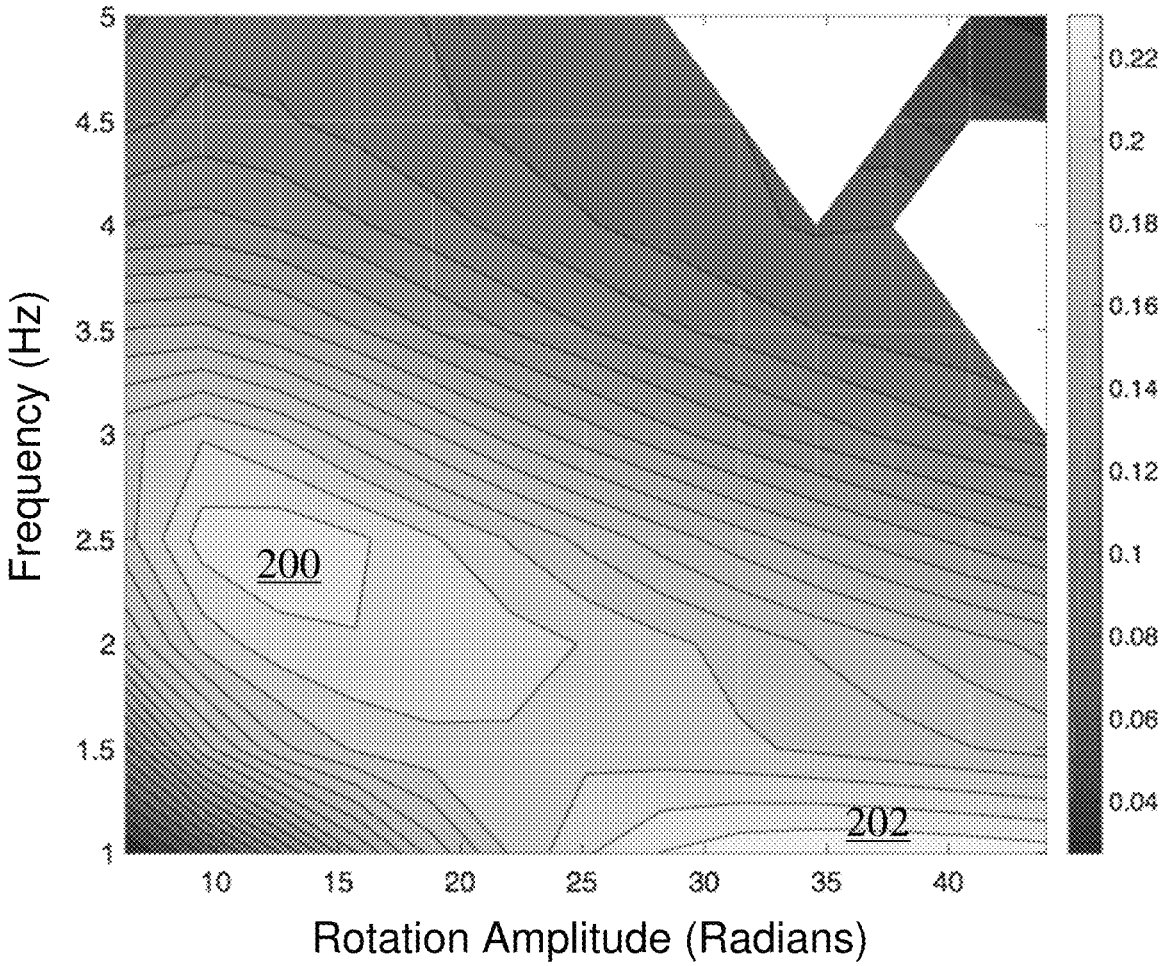
FIG. 16 depicts a graph of simulated data for the model of FIG. 15.

FIG. 16 depicts a graph of simulated data for the model developed relative to the structure illustrated in FIG. 15. Using the model a performance map of the robotic system over a wide range of input parameters was calculated. As shown in the figure, the plot depicts contours of swimming efficiency over a grid of different oscillation frequencies and rotation amplitudes for the internal reaction wheel (i.e. rotatable mass). In the depicted simulated data, the geometry of the robot was fixed to represent a physical prototype. From the resulting plot it was clear there were two efficiency peaks 200, 202 in a lighter shade where a maximum amount of thrust per unit energy input was produced. The peaks correspond to resonance conditions associated with a first resonant mode 202 and a second resonant mode 200 of the flexible fin. Thus, the simulated data may be used to modify the cyclical operation of the rotatable mass to improve efficiency of swimming to match or exceed that of conventional swimming robotic systems.

FIGS. 17A-21 depicts results of simulations of an exemplary dimensionless robotic system according to a model of the robotic system. For the simulation results shown, the simulated robotic system was approximately equivalent to that shown in FIGS. 6-7, with a rotatable mass which induces a reaction torque in a body of the robotic system to deform an elastic flexible fin to generate thrust. The rotatable mass was oscillated between a first direction of rotation and a second direction of rotation in a sinusoidal pattern (e.g., $\omega=\alpha \sin(2\pi f t)$, where f and $\alpha$ were the frequency and amplitude of the motion). The results reflect steady-state behavior determined by simulating the robot over 10 complete gait (i.e., oscillatory) cycles, as it accelerates from rest to a constant velocity. Performance was evaluated based on the dynamics of the robot throughout the final swimming period.

Figure 17A:
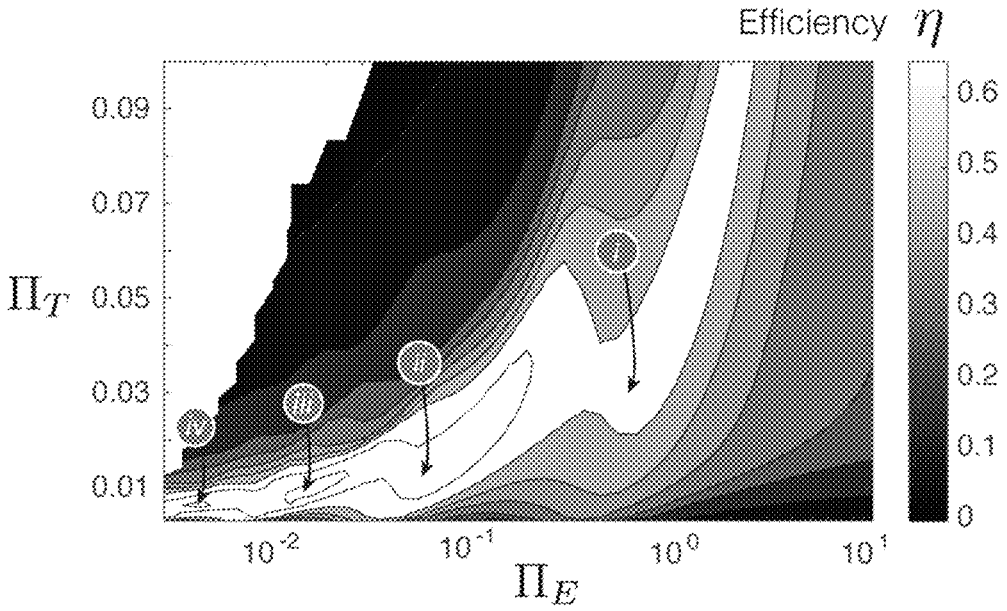
FIG. 17A depicts a simulated contour plot of efficiency versus fin torque and flexural rigidity.

FIG. 17A depicts swimming efficiency $\eta$ plotted over a grid of dimensionless torque amplitude $\Pi_T$ and dimensionless fin flexural rigidity $\Pi_E$. Labels highlight the resonant peaks (i.e., regions where resonance is induced in a flexible fin). As shown in FIG. 17A, the simulation results indicate high efficiency regions surrounding the resonant peaks. That is, surrounding each of the resonant peaks i, ii, iii, iv is a region of high efficiency where $\eta$ is approximately 0.6. This is in contrast to non-resonant areas where thrust efficiency is relatively low. Accordingly, the simulation results shown in FIG. 17A indicate that operating the robotic system with a particular torque and fin flexural rigidity to induce resonance results in a higher efficiency of thrust. As the results shown in FIG. 17A are dimensionless, they may be applied to any robotic system including a rotatable mass and a passive flexible fin.

Figure 17B:
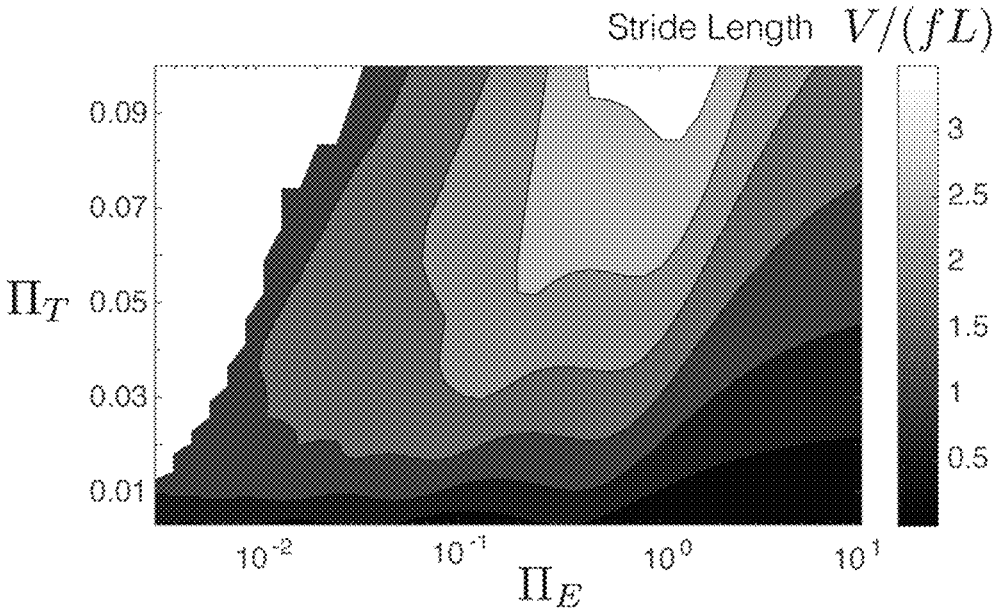
FIG. 17B depicts a simulated contour plot of stride length versus fin torque and flexural rigidity.

FIG. 17B depicts stride length plotted over a grid of dimensionless torque amplitude $\Pi_T$ and dimensionless fin flexural rigidity $\Pi_E$. The dimensionless stride length is defined as the total distance traversed by the robot in a single gait (i.e., oscillatory) cycle. The resulting contours show that the efficient regions shown in FIG. 17A correspond to a broad peak in stride length with values ranging from 0.3 to 1.3 along the efficiency peaks. Although the efficiency plot of FIG. 17A suggests that a robotic system may be efficient with low fin flexural rigidity, the low flexural rigidity may also correlate with a significant drop in stride length. As a result, robotic systems with low flexural rigidity fins may use significantly higher oscillatory frequencies to achieve a given velocity.

Figure 18:
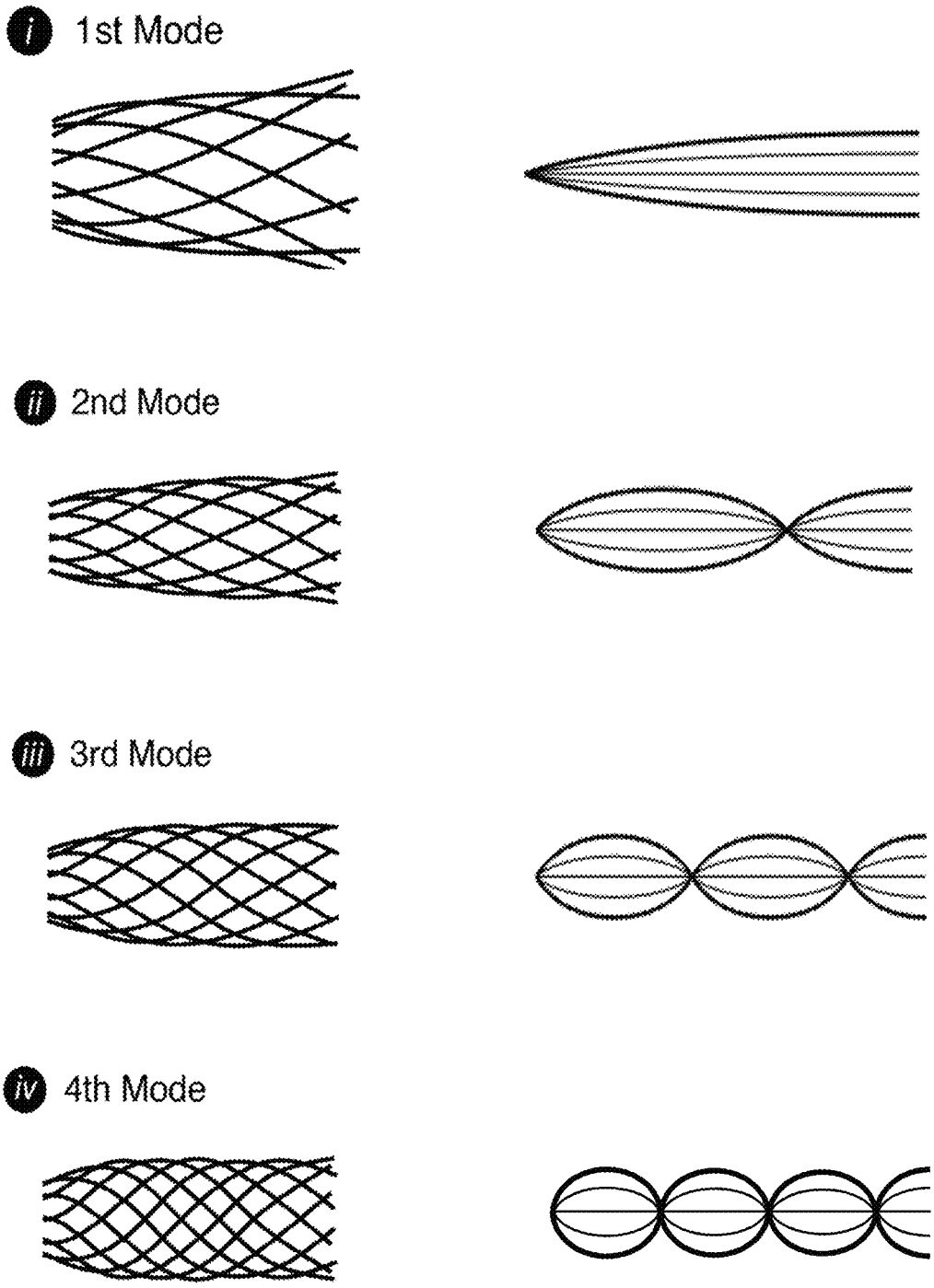
FIG. 18 depicts different resonant modes for one embodiment of a fin.

FIG. 18 depicts shapes of a flexible fin (i.e., fin kinematics) of a dimensionless robotic system robot along the efficiency peaks shown in FIG. 17A. Four resonant mode shapes are depicted, the first resonant mode shape i, second resonant mode shape ii, third resonant mode shape iii, and fourth resonant mode shape iv. The patterns shown in FIG. 18 demonstrate that the fin transitions through higher resonant mode shapes as fin flexural rigidity $\Pi_E$ decreases. In general, the efficiency of a robotic system tends to increase slightly towards the lower flexural rigidity range, attaining a maximum simulated value of $\eta$=0.62 in the vicinity of the fourth resonant mode (see FIG. 17A). As shown in FIG. 18, each of the resonant modes correspond to a theoretical resonant mode shape where one end of the flexible fin is free and the other is fixed (e.g., to a body of the robotic system). The first resonant mode shape approximately corresponds to a quarter of a standing wavelength. Between each of the resonant modes, the standing wavelength increases by half of a standing wavelength. For example, the second resonance mode approximately corresponds to ¾ of a standing wavelength. Of course, depending on the dimensions and characteristics of a flexible fin the flexible fin may have any suitable resonance mode shapes as the present disclosure is not so limited.

Figure 19:
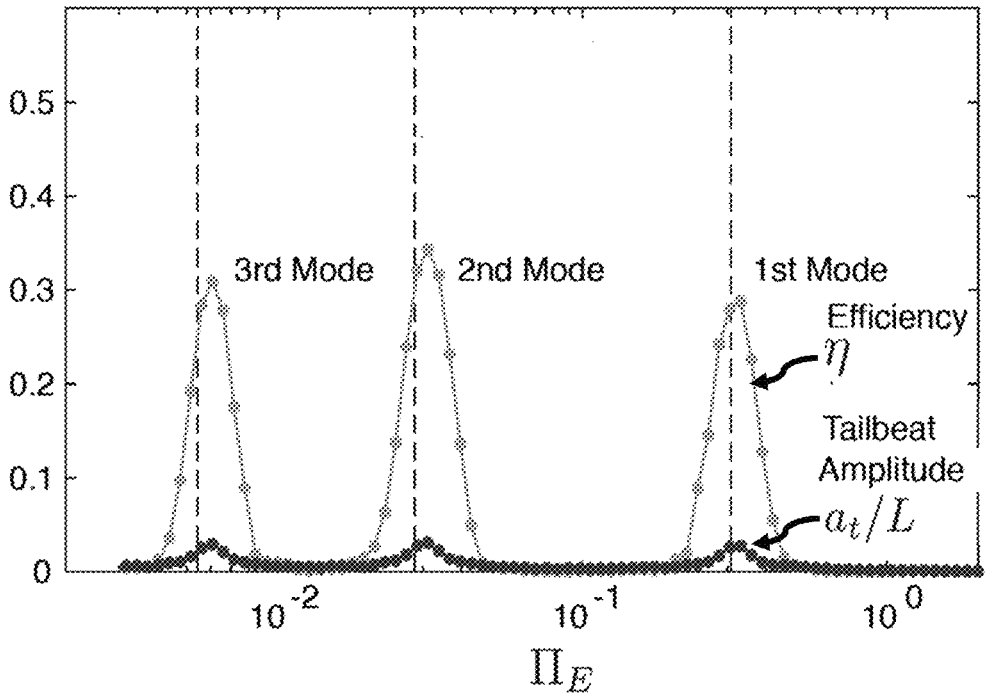
FIG. 19 depicts a simulated plot of tailbeat amplitude and efficiency versus fin flexural rigidity.

FIG. 19 shows hydrodynamic efficiency plotted over a grid of dimensionless fin flexural rigidity and dimensionless actuation torque ($\Pi_E$ and $\Pi_T$). As clearly shown in FIG. 19, the efficiency peaks are associated with first, second, and third resonance modes. Tailbeat amplitude is also plotted over a grid of dimensionless fin flexural rigidity and dimensionless actuation torque ($\Pi_E$ and $\Pi_T$). The dashed lines highlight the resonant conditions where high efficiency peaks are predicted by the simulation. According to the simulated results shown in FIG. 19, a robotic system may be operated in the first, second, or third resonance mode for increased efficiency and tailbeat amplitude.

Figure 20:
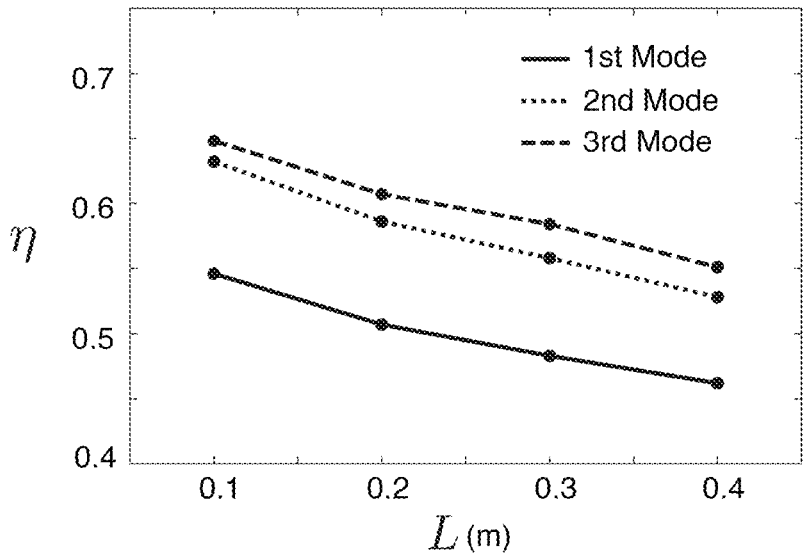
FIG. 20 depicts a simulated plot of peak robotic system velocity versus fin length.

Without wishing to be bound by theory, the sizing of a robotic system is characterized through three primary length scales (for example, see FIGS. 2-4): the length of the body BL, the length of the fin FL, and the width of the body BW. The size of the robotic system body is at least partly determined by components housed within it. For example, the body may be large enough to contain the reaction wheel, the motor, and the electrical systems use to drive them. In contrast, the fin length FL may be altered relatively easily as the fin does not house any other components. To determine a suitable fin length, the hydrodynamic efficiency, $\eta$ was simulated over grids of varying dimensionless torque amplitude $\Pi_T$ and fin stiffness $\Pi_E$, for FL=0.1, 0.2, 0.3 and 0.4 m. In each case, the resulting grid closely resembles the graph shown in FIG. 19, with a broad region of relatively high efficiency and a series of resonant peaks. The value of $\eta$ along these peaks is plotted in FIG. 20 for each of the four FL values. The resulting simulated results in FIG. 20 show that efficiency increases as the fin is shortened.

Figure 21:
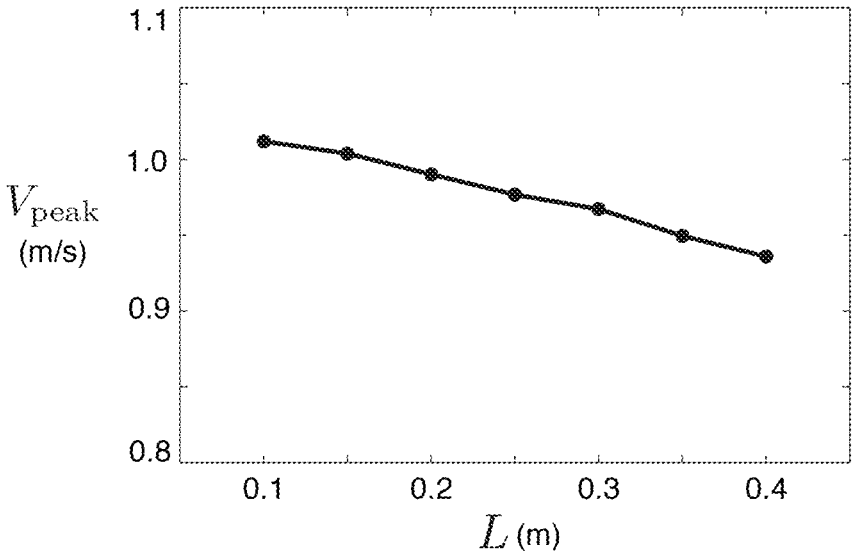
FIG. 21 depicts a simulated plot of efficiency versus fin length for different resonant modes.
Figure 22:
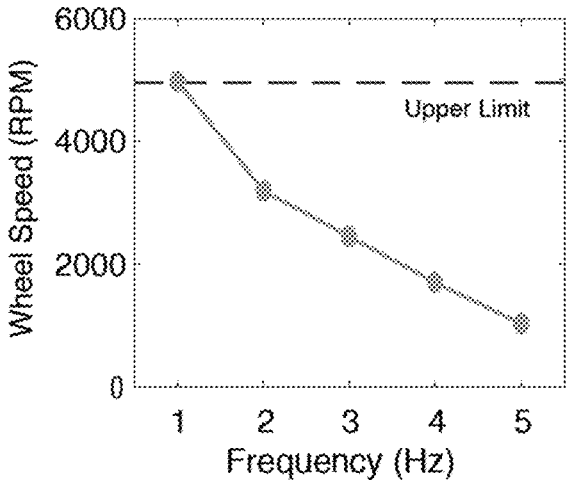
FIG. 22 depicts experimental data of a robotic system showing rotatable mass speed versus frequency.
Figure 23:
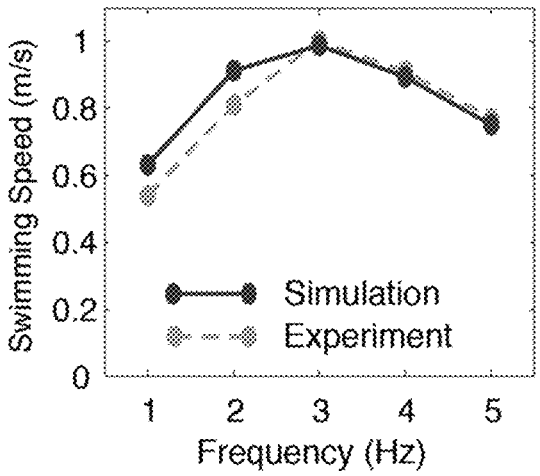
FIG. 23 depicts experimental and simulated data of a robotic system showing speed versus frequency.
Figure 24:
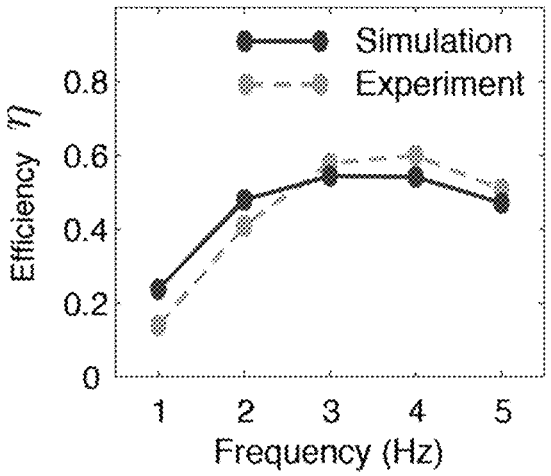
FIG. 24 depicts experimental and simulated data of a robotic system showing efficiency versus frequency.
Figure 25:
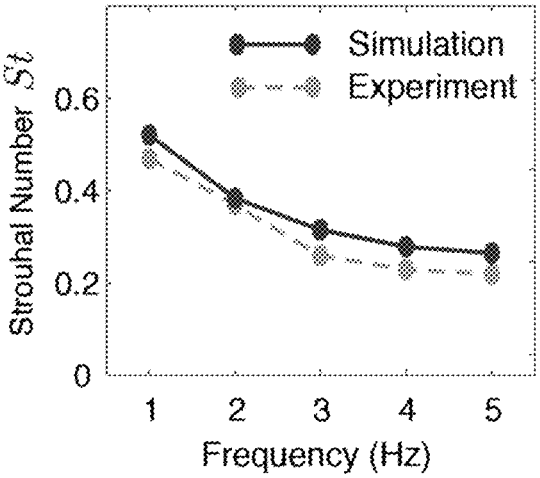
FIG. 25 depicts experimental and simulated data of a robotic system showing Strouhal Number versus frequency.

Alongside efficiency, the simulated peak velocity of the robot, $V_{peak}$ was also considered as shown in FIG. 21. For each fin length, $V_{peak}$ was determined from simulations over the same grid of torque and fin flexural rigidity. Given a set of dimensionless inputs, $\Pi_E$ and $\Pi_T$, the simulation outputs a dimensionless swimming velocity U=V/(f L). According to the simulation shown in FIG. 21, the peak velocity is shown as a dimensioned value. Assumptions to dimension the peak velocity include use of a motor with a peak speed of 5000 RPM ($\dot{\theta}_{lim}$=523.6 rad/s) which can produce a maximum torque of $T_{lim}$=0.3 Nm. As shown in FIG. 21, $V_{peak}$ is plotted for fin lengths ranging from L=0.1-0.4 m. The resulting curve shows that peak velocity also rises slightly as fin length FL decreases. According to the simulated results shown in the graph, a shorter fin length may be more desirable as faster swimming speeds are achievable.

Based on the results of simulations shown in FIGS. 17A-21, an experimental prototype of the robotic system was built. The prototype was designed for a length of roughly 30 cm. At this size the robot was large enough to accommodate some commercially available hardware components, but small enough such that the robot can be tested in a reasonably sized water tank. Table 1 provides a summary of the robot's physical properties.

The experimental robotic system was made up of two primary components: a rigid 3-D printed body and a soft flexible fin. The body structure was printed on a Stratasys Fortus 360 using ABS filament with dissolvable support material. The raw printed part was treated to ensure that it is fully waterproof. The treatment process consisted of first filling in any large defects with automotive body filler and sanding the part smooth. After this, the part was soaked in a low viscosity epoxy resin and allowed to cure for 24 hours. To complete the treatment, the body was sprayed with several coats of black high-fill automotive primer and then finished with semi-gloss clear coat.

TABLE 1

Physical properties of robot prototype.

| Physical Property | Symbol | Value |
|---|---|---|
| Body Mass | $m_b$ | 0.380 kg |
| Body Moment of Inertia | $I_b$ | $2.5 \times 10^{-5}$ kg · m$^2$ |
| Body Length | BL | 0.115 m |
| Body Center of Mass | $l_c$ | 0.063 m |
| Reaction Wheel Mass | $m_w$ | 0.103 kg |
| Reaction Wheel Moment of Inertia | $I_w$ | $6.25 \times 10^{-5}$ kg · m$^2$ |
| Fin Length | FL | 0.2 m |
| Fin Span (Width) | FW | 0.072 m |
| Fin Flexural Stiffness | EI | $5.1 \times 10^3$ N · m$^2$ |
| Fin Specific Mass | $\rho A$ | 0.068 kg/m |
| Motor Constant | $K_v$ | 300 RPM/V |
| Motor Coil Resistance | $R_m$ | 0.45 Ω |
| Motor Frictional Loss | $i_o$ | 0.1 A/10 V |
| Motor Battery Voltage | — | 22.2 V |
| Motor Battery Capacity | — | 150 mAh |
| Teensy Battery Voltage | — | 11.1 V |
| Teensy Battery Capacity | — | 200 mAh |
| Peak Motor Torque | $T_{lim}$ | 0.3 N · m |
| Peak Motor Speed | $\theta_{lim}$ | 5000 RPM |
| Body Drag Coefficient | $C_H$ | 0.22 |
| Transverse Drag Coefficient | $C_D$ | 2 |
| Skin Friction Coefficient | $C_f$ | 0.01 |

The shell structure of the body was formed in two segments: an upper section which contained the power and signal electronics, and lower section which slid over the top to create a sealed pressure vessel. The watertight seal between the sections consisted of two soft Buna-N O-rings, mounted on the upper body section in a radial configuration. Two rigid pectoral stabilizer fins were mounted on the lower section to improve the pitching stability of the robot during steady swimming. The motor and flywheel were mounted on an acrylic plate attached to the upper structure. This design positioned the mass of the reaction wheel below the center of buoyancy to ensure that the system was statically stable in pitch and roll. The robotic system flexible fin was made from PETG (Polyethylene terephthalate glycol-modified) plastic shim stock which was cut to shape on a Universal PLS6MW 75 W laser cutter. The fin was attached to the body section using a press fit into a slot formed on a back portion of the body structure.

The motor of the robotic system was a brushless motor which rotated the internal reaction wheel through a direct drive connection. The choice of this motor was based at least partly on high torque density, low mass (<100 g), and a peak current capability of at least 10 A. In view of these characteristics, the T-motor Antigravity 4004 Brushless outrunner was selected. The motor had a total mass of 59 g, a coil resistance of 0.45Ω, and a torque constant of $K_v$=31.4 A/Nm. Based on these specifications, the system produced up to 0.3 Nm of torque in short bursts. The motor was controlled by a Trinamic TMCM-1640 single axis motor driver. Position feedback was provided by an AMS as5047p rotary encoder. The motor driver was powered by a 6 cell 22.2V lithium polymer battery with a capacity of 150 mAh, while all other components were powered by a separate 3 cell 11.1V lithium polymer battery with a capacity of 200 mAh. Based on the motor constant ($K_v$=31.4 A/Nm=300 RPM/V), the battery voltage allowed for a peak reaction wheel (i.e., rotatable mass) speed of approximately 6000 RPM, however, the wheel's speed was limited to 5000 RPM to avoid commutation effects that can occur at higher rotation rates.

The body of the robot had a length of BL=11.5 cm and an approximate span of BW=7.2 cm, which was selected to be small while still providing sufficient volume to contain the internal components. The fin was designed with a flexural stiffness of $EI=5.1\times10^{-3}$ N·m$^2$ and the rotatable mass was sized for a mass of 103 g with a rotational inertia of $I_w=6.25\times10^{-5}$ kg·m$^2$.

Swimming tests were conducted in a 3×4 m tank with a water depth of 1 m. An overhead camera was used to record the movement of the robotic system. Throughout each test, the rotatable mass was continuously driven in a oscillatory sinusoidal pattern, $\omega=\alpha \sin(2\pi f t)$. To evaluate swimming performance, the robot was released at a depth of approximately 30 cm and allowed to accelerate for at least 3 complete fin beats. Performance was then determined based on the measured dynamics of the robot throughout a single complete swimming cycle. To explore the capabilities of the robotic system, tests were conducted at oscillatory frequencies ranging from 1-5 Hz. At all frequencies, the reaction wheel torque was set to a highest possible value for the motor. Results of these tests are shown in FIGS. 22-25, where speed, efficiency, and Strouhal number of the robot were compared with the simulated model predicted values. Speed and Strouhal number were measured directly from videos of the swimmer, while efficiency was calculated based on the torque and velocity output of the reaction wheel, as recorded by the motor encoder. A head drag coefficient $C_H$ of 0.22 was used to tune the results for comparison between the simulated results and the experimental results. As shown in FIGS. 22-25, the observed performance of the robot was quite close to the predicted performance. The robotic system achieved a peak efficiency of $\eta$=0.6 and a peak velocity of 1 m/s. For the 3-5 Hz cases, where efficiency was high, the robot swims in a St range of 0.22-0.26 which was consistent with predicted Strouhal Number values.

In addition to steady state forward propulsion, the experimental robotic system was used to replicate the C-start maneuver discussed previously. To mimic this behavior, the motor was commanded to generate a brief high torque pulse, accelerating the reaction-wheel to its maximum speed of 5000 RPM over a period of 0.145 s. This produced a motion where the robot turned a full 180 degrees with a peak angular velocity of 515 deg/s. Thus, the experimental robotic system demonstrated the capability to perform a C-start maneuver.

Previously, the power economy of a robotic system in terms of its quasi-propulsive efficiency ($\eta$) is described above. This metric serves as an effective metric to characterize swimming hydrodynamics, but may not provide a full picture of a robotic system power consumption. In some cases, it may be desirable to account for the efficiency of the motor and the power consumption of the electrical components used for all other tasks, such as sensing, communication, and control. Cost of transportation (CoT) may be used for this purpose, which consists of a dimensionless ratio of the total power consumption of the system over velocity times weight. In the case of the experimental robotic system, an overall minimum of CoT=1.142 at 0.32 m/s (~1 body lengths/s) was exhibited. This cost of transportation is comparable with swimming Rainbow Trout (*Oncorhynchus mykiss*). In particular, the experimental robotic system performance substantially matches the Trout at 0.2 m/s.

The above-described embodiments of the technology described herein can be implemented in any of numerous ways. For example, the embodiments may be implemented using hardware, software or a combination thereof. When implemented in software, the software code can be executed on any suitable processor or collection of processors, whether provided in a single computing device or distributed among multiple computing device associated with a robotic system. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Also, a computing device associated with the disclosed robotic systems may have one or more input and output devices. These devices can be used, among other things, to present a user interface. Examples of output devices that can be used to provide a user interface include display screens, LED's, and/other appropriate visual indicators for visual presentation of output and speakers or other sound generating devices for audible presentation of output. Examples of input devices that can be used for a user interface include keyboards, and pointing devices, such as mice, touch pads, and digitizing tablets which may either be wired or wirelessly connected to the robotic systems. As another example, a computer may receive input information through speech recognition or in other audible format.

Such computing devices may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present disclosure as discussed above. Additionally, it should be appreciated that according to one aspect of this embodiment, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

What is claimed is:

1. A robotic system comprising:

a body;

at least one flexible fin attached to the body at a first location; and a first rotatable mass operatively coupled to the body at a second location removed and separate from the at least one flexible fin, wherein angular acceleration of the first rotatable mass relative to the body creates a reaction torque that rotates the body to deform the at least one flexible fin.

2. The robotic system of claim 1, further comprising a motor configured to cyclically rotate the first rotatable mass in a first direction of rotation and a second direction of rotation.

3. The robotic system of claim 1, further comprising a motor configured to rotate the first rotatable mass in a single direction.

4. The robotic system of claim 1, further comprising a motor configured to cyclically accelerate the first rotatable mass in a first rotational direction and a second rotational direction opposite the first rotational direction at a predetermined frequency.

5. The robotic system of claim 4, wherein the predetermined frequency is a resonance frequency of the at least one flexible fin.

6. The robotic system of claim 5, wherein the resonance frequency is between or approximately equal to 2 and 5 Hz.

7. The robotic system of claim 1, further comprising a second rotatable mass operatively coupled to the body, wherein the first rotatable mass rotates about a first axis, wherein the second rotatable mass is oriented to rotate about a second axis orthogonal to the first axis, and wherein angular acceleration of the second rotatable mass relative to the body creates a reaction torque that rotates the body about the second axis.

8. The robotic system of claim 7, further comprising a third rotatable mass operatively coupled to the body, wherein the third rotatable mass is oriented to rotate about a third axis orthogonal to the first axis and the second axis, wherein angular acceleration of the third rotatable mass relative to the body creates a reaction torque that rotates the body about the third axis.

9. The robotic system of claim 1, wherein the first rotatable mass has an average angular velocity of zero during at least one mode of operation.

10. The robotic system of claim 1, wherein the first rotatable mass has an average angular velocity that is non-zero during at least one mode of operation.

11. The robotic system of claim 1, wherein the angular acceleration of the first rotatable mass is greater in at least one of magnitude and duration in a first direction of rotation than in a second direction of rotation when cyclically operated in at least one mode of operation.

12. The robotic system of claim 1, wherein the first rotatable mass is disposed vertically below a center of mass of the robotic system when the robotic system is in an equilibrium position within water.

13. The robotic system of claim 1, wherein the first rotatable mass is positioned between a center of mass of the robotic system and a portion of the body opposite the first location where the at least one flexible fin is attached to the body.

14. The robotic system of claim 1, wherein the at least one flexible fin has a flexural rigidity gradient extending from a proximal portion of the at least one flexible fin to a distal portion of the at least one flexible fin.

15. The robotic system of claim 1, wherein the at least one flexible fin has a constant flexural rigidity along a length of the at least one flexible fin.

16. A method for operating a robotic system, the method comprising:

applying an angular acceleration to a first rotatable mass relative to a body the first rotatable mass is operatively coupled with to apply a reaction torque to the body;

rotating the body in response to the reaction torque applied to the body; and deforming at least one flexible fin attached to the body at a location removed and separate from the first rotatable mass in response to rotating the body.

17. The method of claim 16, further comprising cyclically rotating the first rotatable mass in a first direction of rotation and a second direction of rotation.

18. The method of claim 16, further comprising rotating the first rotatable mass in a single direction.

19. The method of claim 16, further comprising cyclically accelerating the first rotatable mass in a first rotational direction and a second rotational direction opposite the first rotational direction at a predetermined frequency.

20. The method of claim 19, wherein the predetermined frequency is a resonance frequency of the at least one flexible fin.

21. The method of claim 20, wherein the resonance frequency is between or approximately equal to 2 and 5 Hz.

22. The method of claim 16, further comprising applying an angular acceleration to a second rotatable mass operatively coupled to the body, wherein the first rotatable mass rotates about a first axis, wherein the second rotatable mass is oriented to rotate about a second axis orthogonal to the first axis, and wherein applying the angular acceleration to the second rotatable mass creates a reaction torque that rotates the body about the second axis.

23. The method of claim 22, further comprising applying an angular acceleration to a third rotatable mass operatively coupled to the body, wherein the third rotatable mass is oriented to rotate about a third axis orthogonal to the first axis and the second axis, wherein applying the angular acceleration to the third rotatable mass creates a reaction torque that rotates the body about the third axis.

24. The method of claim 16, wherein the first rotatable mass has an average angular velocity of zero during at least one mode of operation.

25. The method of claim 16, wherein the first rotatable mass has an average angular velocity that is non-zero during at least one mode of operation.

26. The method of claim 16, wherein the angular acceleration of the first rotatable mass is greater in at least one of magnitude and duration in a first direction of rotation than in a second direction of rotation when cyclically operated in at least one mode of operation.

27. The method of claim 16, wherein the first rotatable mass is disposed vertically below a center of mass of the robotic system when the robotic system is in an equilibrium position within water.

28. The method of claim 16, wherein the first rotatable mass is positioned between a center of mass of the robotic system and a portion of the body opposite an attachment location of the at least one flexible fin.

29. The method of claim 16, wherein the at least one flexible fin has a flexural rigidity gradient extending from a proximal portion of the at least one flexible fin to a distal portion of the at least one flexible fin.

30. The method of claim 16, wherein the at least one flexible fin has a constant flexural rigidity along a length of the at least one flexible fin.

31. A method for operating a robotic system, the method comprising:

cyclically rotating a body in a first direction of rotation and a second direction of rotation at a predetermined frequency; and deforming at least one flexible fin attached to the body in response to rotating the body, wherein the predetermined frequency is a resonance frequency of the at least one flexible fin.

32. The method of claim 31, wherein cyclically rotating the body comprises applying an angular acceleration to a first rotatable mass relative to the body to apply a reaction torque to the body.

33. The method of claim 32, further comprising cyclically rotating the first rotatable mass in the first direction of rotation and the second direction of rotation.

34. The method of claim 32, further comprising rotating the first rotatable mass in a single direction.

35. The method of claim 31, wherein the resonance frequency is between or approximately equal to 2 and 5 Hz.

36. The robotic system of claim 1, wherein a leading edge of the at least one flexible fin is located proximate the first location, and wherein the leading edge of the at least one flexible fin moves in conjunction with the body such that rotation of the body within a surrounding fluid applies a force that resists movement of the at least one flexible fin to deform the at least one flexible fin along an axial length of the at least one fin, and wherein the at least one flexible fin is biased towards a non-deformed configuration to generate a thrust applied to the body.

37. The method of claim 16, further comprising:

moving a leading edge of the at least one flexible fin in conjunction with rotation of the body such that rotation of the body within a surrounding fluid applies a force that resists movement of the at least one flexible fin to deform the at least one flexible fin along an axial length of the at least one flexible fin; and biasing the at least one flexible fin towards a non-deformed configuration to generate a thrust applied to the body.

* * * * *